US008523381B1

(12) United States Patent
Clements et al.

(10) Patent No.: US 8,523,381 B1
(45) Date of Patent: Sep. 3, 2013

(54) SYSTEMS, METHODS AND DEVICES FOR A TURRET-TYPE SOCKET FOR A FLUORESCENT LIGHT FIXTURE

(75) Inventors: Russ Clements, Newman, GA (US); Rodney Jacobs, Vienna, GA (US); Danny Cape, Hawkinsville, GA (US)

(73) Assignee: Cooper Technologies Company, Houston, TX (US)

( * ) Notice: Subject to any disclaimer, the term of this patent is extended or adjusted under 35 U.S.C. 154(b) by 211 days.

(21) Appl. No.: 13/174,152

(22) Filed: Jun. 30, 2011

Related U.S. Application Data

(60) Provisional application No. 61/360,248, filed on Jun. 30, 2010.

(51) Int. Cl.
*F21S 4/00* (2006.01)

(52) U.S. Cl.
USPC ..... 362/217.1; 362/260; 362/217.11; 362/147; 362/225

(58) Field of Classification Search
USPC ..... 362/260, 217.1, 217.11, 217.13, 362/225, 362, 222, 223, 224, 147, 148, 150
See application file for complete search history.

(56) References Cited

U.S. PATENT DOCUMENTS

| | | | | |
|---|---|---|---|---|
| 4,580,200 | A * | 4/1986 | Hess et al. | 362/223 |
| 6,585,396 | B1 | 7/2003 | Verfuerth | |
| 7,674,005 | B2 * | 3/2010 | Chung et al. | 362/223 |
| 8,246,196 | B2 * | 8/2012 | Chung et al. | 362/223 |
| 2011/0063873 | A1 * | 3/2011 | Parker et al. | 362/609 |

OTHER PUBLICATIONS

Lithonia Lighting, Product Specification Sheet, Heavy-Duty Turret Strip, SL Slimline; May 1996.
Lithonia Lighting, Product Specification Sheet, Heavy-Duty Turret Strip, SL High Output; May 1996.
Lithonia Lighting, Product Specification Sheet, Heavy-Duty Industrial, AFP; Feb. 18, 2008.
Lithonia Lighting, Product Specification Sheet, Heavy-Duty Turret Industrial, AF; Jul. 20, 2007.
Lsi Industries, Product Specification Sheet, Turret Type, F23; May 5, 2011.
Day-Brite Lighting, Product Specification Sheet, Turret Strip, Slimline T8 or T12; Oct. 2007.
Day-Brite Lighting, Product Specification Sheet, Turret Strip, T8 or T12; Oct. 2007.
Day-Brite Lighting, Product Specification Sheet, T5 Specification Industrial, T5 or T5HO; Dec. 2007.

(Continued)

*Primary Examiner* — Ali Alavi
(74) *Attorney, Agent, or Firm* — King & Spalding LLP

(57) ABSTRACT

A light fixture includes first and second industrial socket housings and a wireway. The socket housings are coupled to each end of the wireway. Each socket housing can be constructed as a two-piece housing and includes turret-type fluorescent lamp sockets. The two-piece housing includes an end cap and a socket track coupled together. The end cap includes an end wall having at least one socket hole with a turret-type fluorescent lamp socket mounted thereon. At least one female turret-type socket is mounted in the first socket housing and at least one male turret-type socket is mounted in the second socket housing such that the male and female sockets are opposite each other. A fluorescent lamp having opposing ends is receivable at each end by one of the male and female turret-type sockets. The light fixture may also include one or more reflectors to reflect light emitted by the lamp.

22 Claims, 27 Drawing Sheets

(56) References Cited

OTHER PUBLICATIONS

Williams Fluorescent Lighting, Product Specification Sheet, Specification Grade Turret Strip, Voltage Type Job Series 78, Feb. 2, 2010.
Williams Fluorescent Lighting, Product Specification Sheet, T5 or T8 Premium Turret V-style Industrial, Voltage Type Job Series 85, Aug. 27, 2010.
Williams Fluorescent Lighting, Product Specification Sheet, T5 or T8 Premium Turret Industrial Porcelain, Voltage Type Job Series 83, Aug. 27, 2010.
Williams Fluorescent Lighting, Product Specification Sheet, T5 or T8 Premium Turret Industrial, Voltage Type Job Series 82, Aug. 27, 2010.
Columbia Lighting, Product Specification Sheet, Premium Industrial, KL VR BI-PIN, Feb. 3, 2011.
Columbia Lighting, Product Specification Sheet, Premium Industrial, KL SLIMLINE, Nov. 2, 2010.
Columbia Lighting, Product Specification Sheet, Premium Industrial, KL High Output, Nov. 2, 2010.
Columbia Lighting, Product Specification Sheet, Premium Industrial, KL BI-PIN, May 13, 2010.
Columbia Lighting, Product Specification Sheet, Premium Industrial, IC Slimline, Jul. 1, 2010.
Columbia Lighting, Product Specification Sheet, Premium Industrial, IC High Output, Jul. 1, 2010.
Columbia Lighting, Product Specification Sheet, Premium Industrial, IC BI-PIN, Feb. 3, 2011.
Columbia Lighting, Product Specification Sheet, Premium Turret Industrial, IC Slimline, Jul. 1, 2010.

* cited by examiner

SYSTEMS, METHODS AND DEVICES FOR A TURRET-TYPE SOCKET FOR A FLUORESCENT LIGHT FIXTURE

RELATED APPLICATIONS

This application claims priority under 35 U.S.C. §119 to U.S. Provisional Patent Application No. 61/360,248 titled, "Systems, Methods, and Devices for a Turret-Type Socket for a Fluorescent Light Fixture," filed on Jun. 30, 2010, the entire contents of which are hereby fully incorporated herein by reference.

TECHNICAL FIELD

Embodiments of the invention relate generally to a fluorescent light fixture, and more particularly to systems, methods, and devices for providing a turret-type light socket on a high bay fluorescent light fixture.

BACKGROUND

Several categories of lighting fixtures exist for warehouse/factory-type applications, including: high bay and low bay. Industrial buildings and workplaces require lighting systems that provide appropriate quantities of energy-efficient lighting. High bay (sometimes referred to as "hibay") applications typically have a mounting height between 20 and 40 feet above the floor and the fixtures are individually mounted as "point sources." Low bay applications typically have a mounting height less than 20 feet above the floor and the fixtures are mounted in close proximity to each other, and in some cases the fixtures may even touch one another. High bay fixtures typically have their own power sources, while low bay fixtures typically have power supplied to multiple fixtures in a row through a daisy chain.

High bay spaces are typically found in warehouses, factories, large retail stores, and athletic facilities. High-intensity Discharge (HID) light sources, such as metal halide and high-pressure sodium lamps, have long dominated the market for lighting indoor spaces with high ceilings (high bay). HID lamps are typically installed in fixtures that direct their light using parabolic reflectors, which gives them the ability to concentrate light on horizontal work surfaces from lofty mounting heights. However, HID fixtures have negative mercury disposal issues and they are considered "point sources" because they produce intense light in such a small area. For years, fluorescent lamps have been used in low bay applications. Fluorescent lamps emit diffuse light from long glass tubes. This characteristic of diffusivity has enabled fluorescent fixtures to dominate the market for lighting low bay applications. Recently, more intense and efficient fluorescent lamps have been developed (called High-intensity Fluorescent (HIF) lamps), which have enabled fluorescent systems to break through the ceiling-height barrier to compete directly with HID fixtures in the high bay market.

High bay applications tend to have environments that are relatively more harsh and corrosive than low bay applications. In particular, high bay environments can have more airborne dust and oil particulates. Unlike HID lamps, which typically have male-threaded electrodes that screw into female-threaded sockets, fluorescent lamps have exposed pin-type electrodes at the ends of the tubes. Current fluorescent high bay lighting products in the marketplace are designed to use twist-lock or roto-lock style sockets with no protective metal enclosure around the sockets. These types of sockets can cause failure of the fluorescent lamp or fixture when exposed to harsh industrial environments, such as those that expose the fluorescent light fixture and its sockets to oils and solvents.

SUMMARY

In accordance with the teachings of the present disclosure, disadvantages and problems associated with existing light fixtures have been reduced.

According to one aspect of the invention, a light fixture is provided comprising a two-piece housing for turret-type fluorescent lamp sockets for high bay industrial applications, the two-piece housing comprising: an end cap that is a first piece; and a socket track that is a second piece comprising an end wall having at least one socket hole, whereby a turret-type fluorescent lamp socket is mountable in the at least one socket hole, wherein the end cap and socket track connect with each other to form the housing.

A further aspect of the invention provides a fluorescent luminaire fixture for high bay industrial applications, the fixture comprising: a first industrial socket housing; a second industrial socket housing; a wire way comprising a first end and a second end, the first end of the wire way coupled to the first socket housing and the second end of the wire way coupled to the second socket housing; at least one female turret-type socket mounted in the first socket housing and at least one male turret-type socket mounted in the second socket housing such that the male and female turret-type sockets are opposite each other, whereby a fluorescent lamp is receivable by the male and female turret-type sockets; and at least one reflector positioned relative to the male and female turret-type sockets, whereby light from a fluorescent lamp received by the male and female turret-type sockets is reflectable by the at least one reflector for a high bay application.

Still another aspect of the invention provides a fluorescent luminaire fixture for high bay industrial applications, the fixture comprising: first and second industrial socket housing, wherein each of the first and second industrial socket housings comprises: a first piece, and a second piece comprising at least one socket hole, whereby a turret-type fluorescent lamp socket is mountable in the at least one socket hole, and wherein the first and second pieces connect with each other to form an industrial socket housing; a wire way comprising a first end and a second end, the first end of the wire way coupled to the first industrial socket housing and the second end of the wire way coupled to the second industrial socket housing; at least one female turret-type socket mounted in the first industrial socket housing and at least one male turret-type socket mounted in the second industrial socket housing such that the male and female turret-type sockets are opposite each other, whereby a fluorescent lamp is receivable by the male and female turret-type sockets; and at least one reflector connected directly to the first and second industrial socket housings and positioned relative to the male and female turret-type sockets, whereby light from a fluorescent lamp received by the male and female turret-type sockets is reflectable by the at least one reflector for a high bay application.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features. Reference will now be made to the accompanying drawings, which are not necessarily drawn to scale, and wherein.

Figure 1:
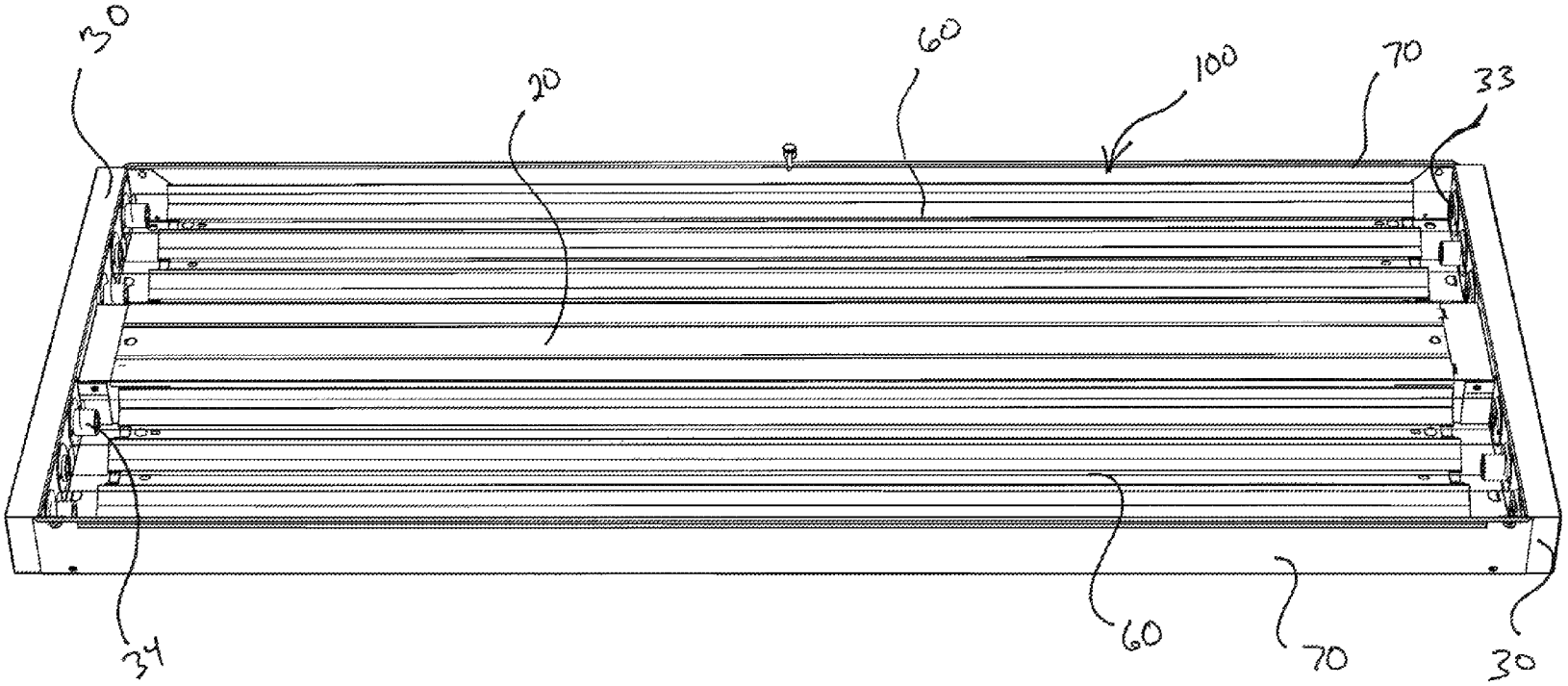
FIG. 1 is a perspective view and a fluorescent light fixture with turret-type sockets in accordance with one exemplary embodiment of the present invention.
Figure 2:
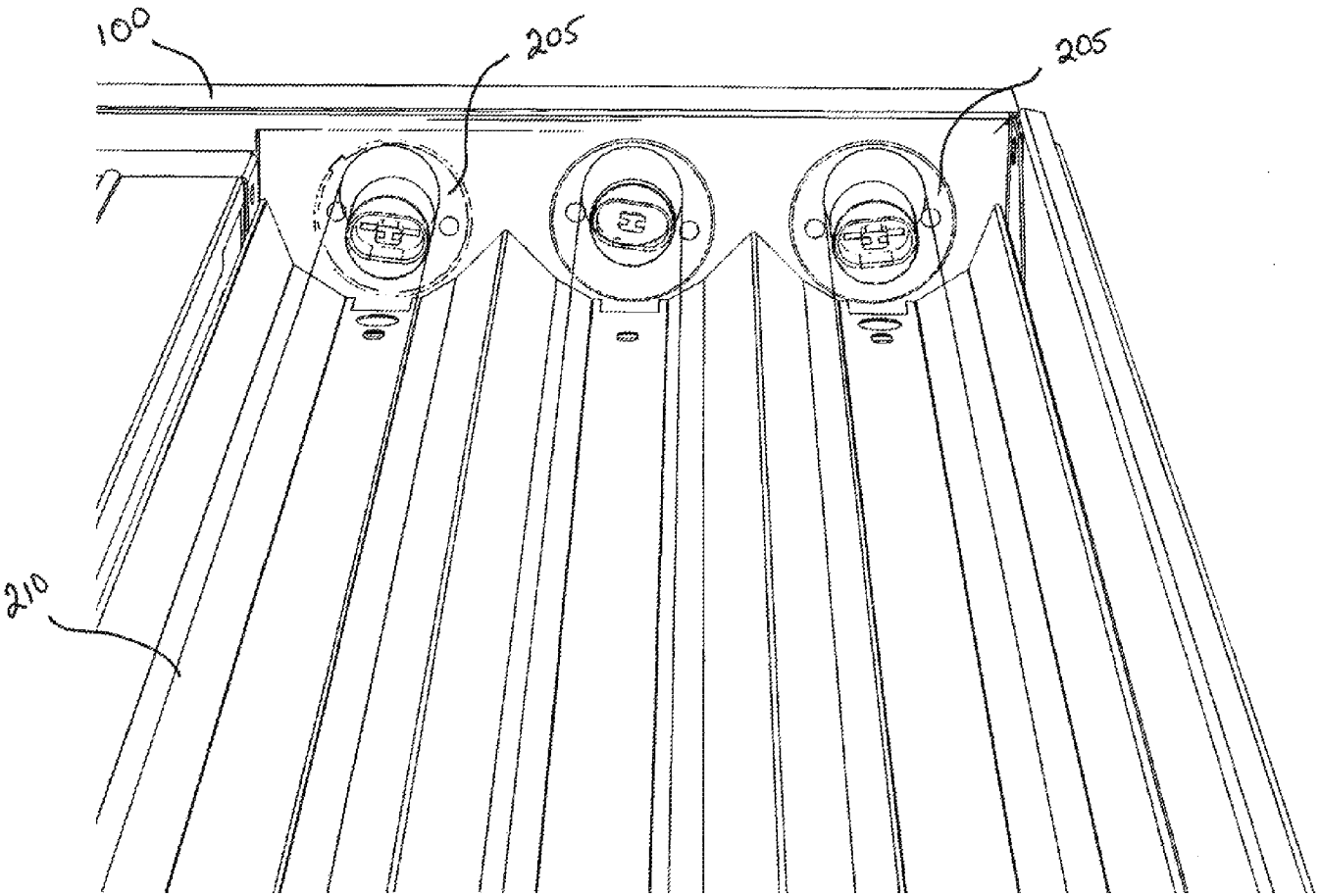
FIG. 2 is a partial perspective view of the fluorescent light fixture of FIG. 1 showing the turret-type sockets with fluorescent lamps coupled thereto in accordance with the exemplary embodiment of FIG. 1.
Figure 3:
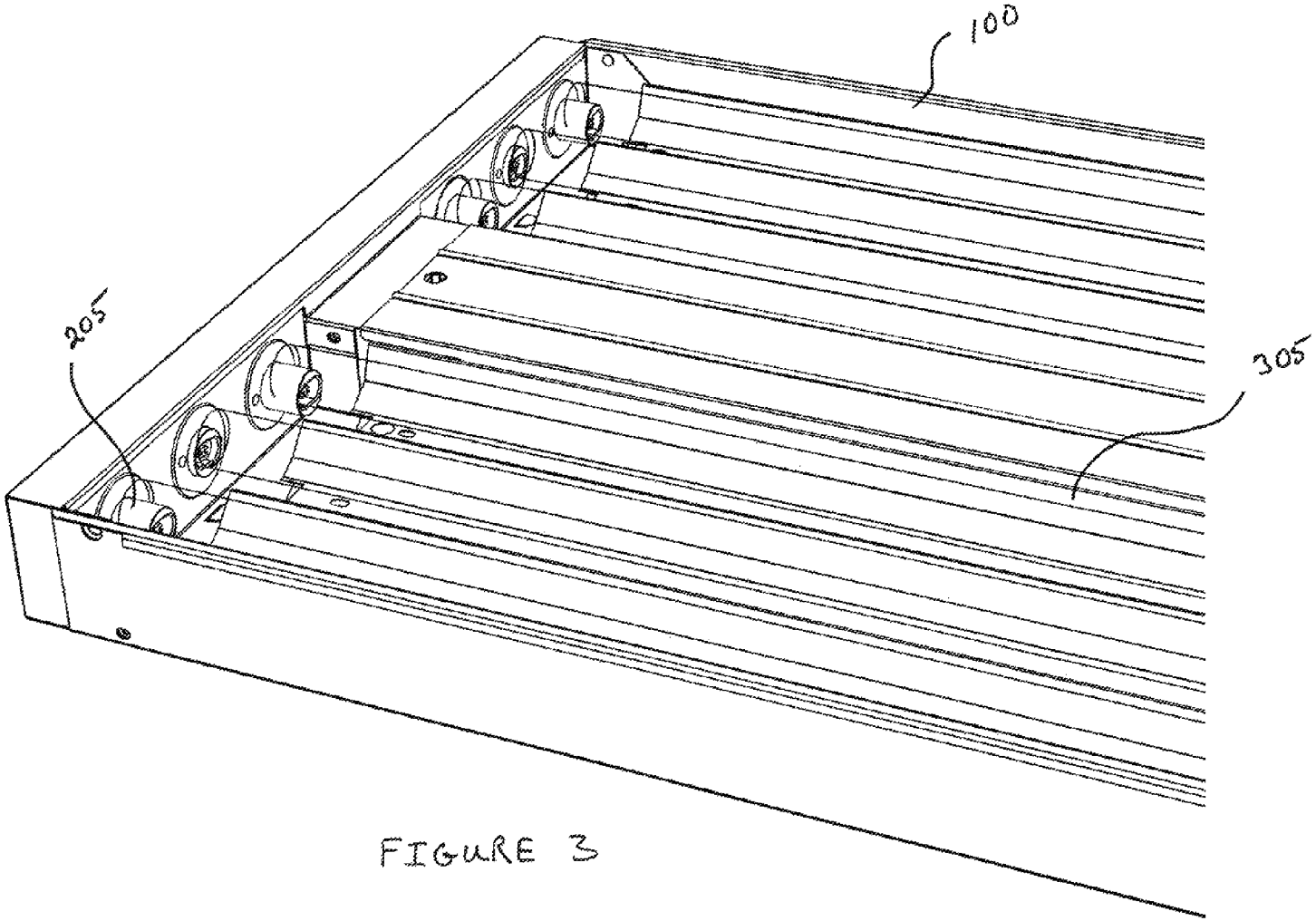
FIG. 3 is another partial perspective view of the fluorescent light fixture of FIG. 1 showing the turret-type sockets in accordance with the exemplary embodiment of FIG. 1.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements.

DETAILED DESCRIPTION

Preferred embodiments and their advantages over the prior art are best understood by reference to FIGS. 1-19 below. However, the present disclosure may be more easily understood in the context of a high level description of certain embodiments.

Embodiments of the present invention are directed to a fluorescent light fixture having turret-type sockets to protect the electrical connection point between the lamp and the lamp socket from harsh industrial environments. FIGS. 1-7 present an exemplary embodiment for a fluorescent light fixture 100 having turret-type sockets 205. Referring now to FIGS. 1-7, the fixture 100 is designed for exposure to harsh industrial environments including, but not limited, environments where the fixture 100 is subject to contact with oils and solvents. While the exemplary fixture 100 of FIGS. 1-7 presents a fixture 100 having six total lamps 210, in certain exemplary embodiments, the fixture 100 can be modified to hold greater or fewer lamps 210. In one exemplary embodiment, the fixture can hold anywhere between two and ten lamps 210. The lamps 210 can be any type of elongated fluorescent lamp including, but not limited to, a T5 or T8 lamps.

Figure 4:
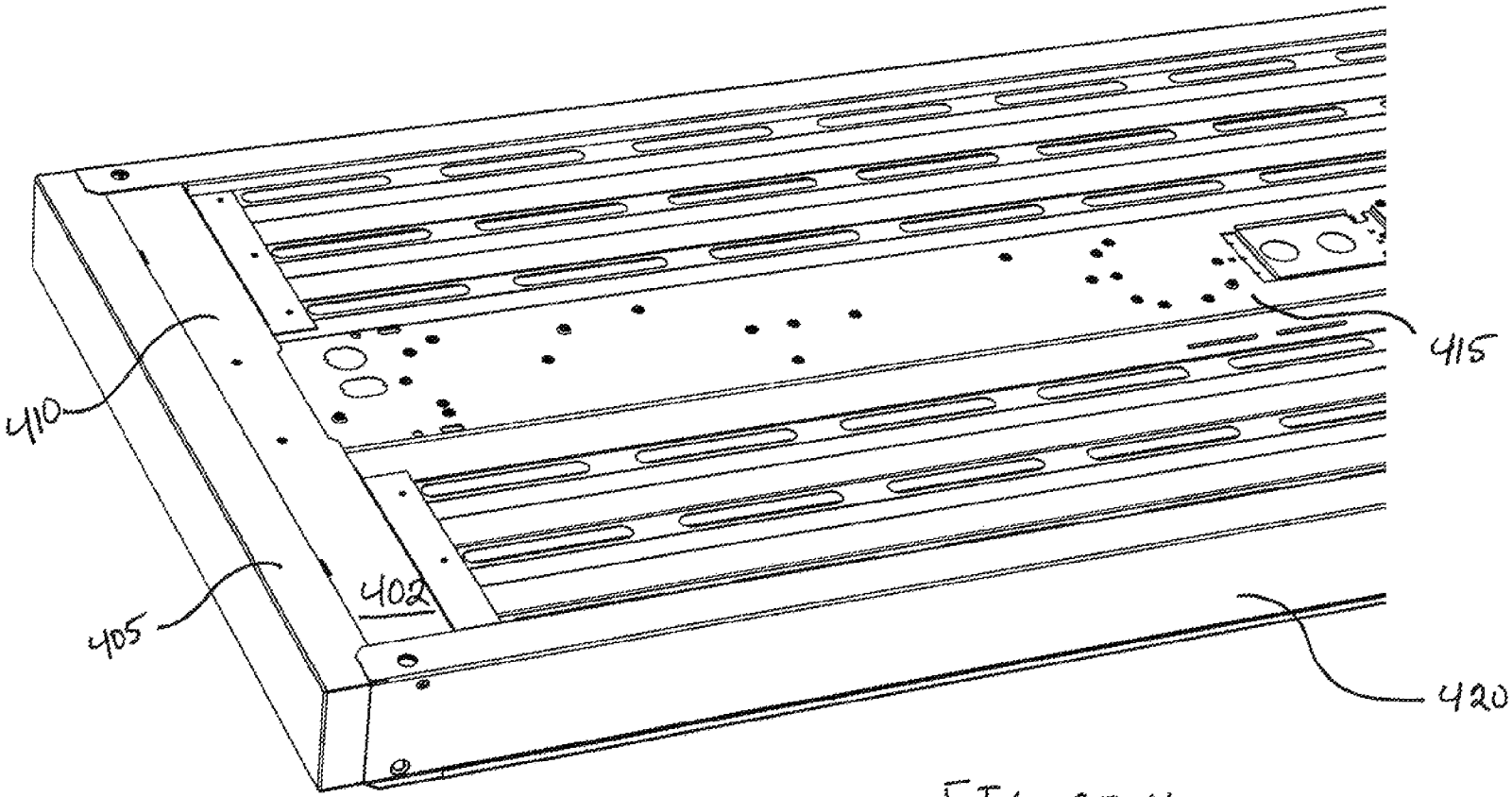
FIG. 4 is another partial perspective view of the fluorescent light fixture of FIG. 1 showing the clam shell design between the endcap and the socket track in accordance with the exemplary embodiment of FIG. 1.
Figure 5:
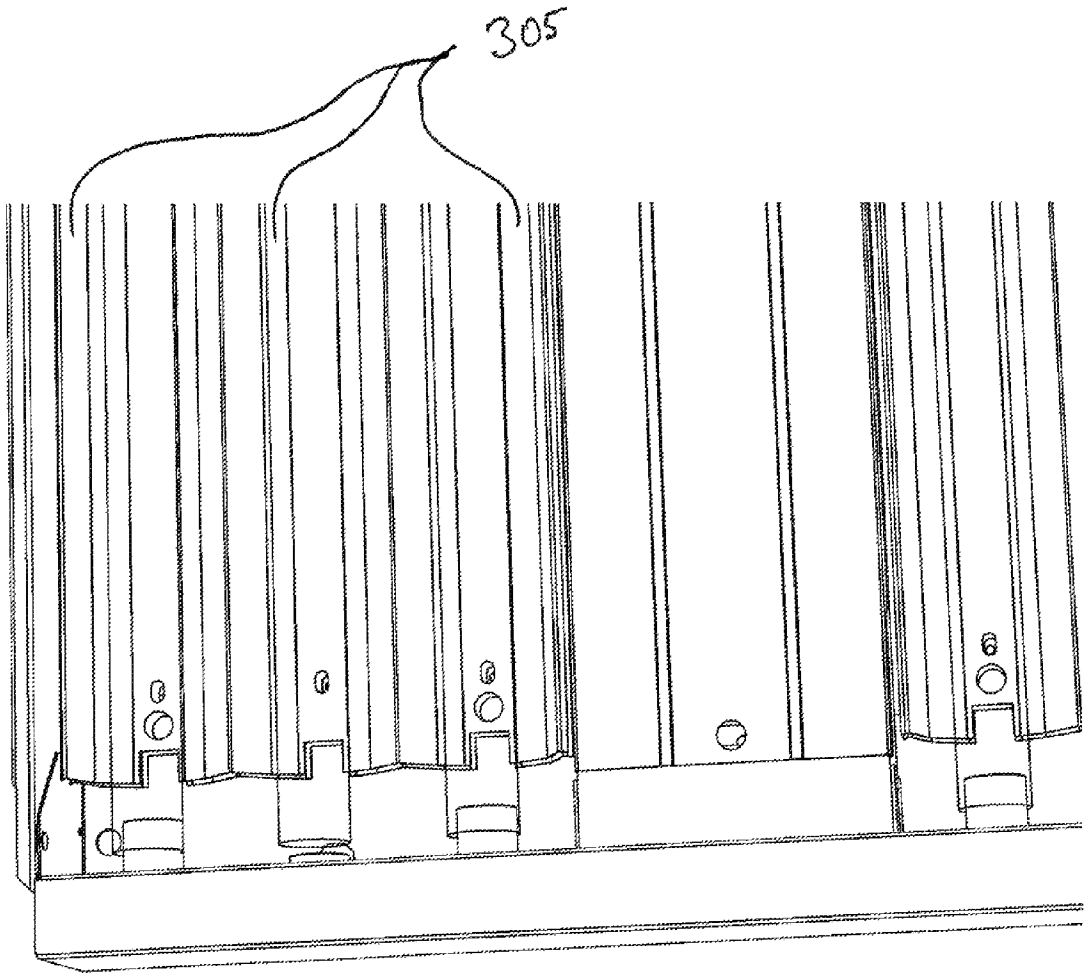
FIG. 5 is another partial perspective view showing the reflector mounting to the turret socket tracks in accordance with the exemplary embodiment of FIG. 1.

The fixture includes one or more turret-type sockets 205. In one exemplary embodiment, the turret-type socket 205 is a spring-loaded socket. The use of the spring loaded turret-type sockets 205 provides greater lamp 210 retention in the socket 205 during conditions of vibration and compensates for the slight variation in lamp lengths. The turret-type socket 205 provides a protective electrical connection point between one end of a lamp 210 and the fixture 100 by providing a metal cover surrounding the electrical connection point between the lamp 210 and the socket 205 and capable of receiving a portion of the end of the lamp therein. The turret-type socket 205 allows the electrical connection point between the lamp 210 and the socket 205 to withstand harsh industrial environments by enclosing the connection area of the lamp 210 inside the oil resistant thermoplastic socket 205, which is enclosed in a sheet metal enclosure. As seen in FIG. 4, in one exemplary embodiment, the turret-type socket 205 further includes a metal enclosure 402 made up of two parts: a turret end cap 405; and a turret socket track 410. The socket material itself can withstand the harsh environments and can hold up to the oils and solvents unlike the roto-lock style sockets typically used in high bay industrial applications. The turret end cap 405 and the turret socket track 410 conceal wiring to the turret-type sockets 205 and prevent risk of shock to a user attempting to access the area covered by the socket track 410 and end cap 405. In addition, the turret end cap 405 and socket track 410 protect the sockets 205 and associated wiring for the fixture 100 from corning into contact with or being damaged by foreign objects. In certain exemplary embodiments, the combination of the end cap 405 and the socket track 410 has a clam shell design. The clam shell design provides additional structural stiffness across both ends of the fixture 100.

In certain exemplary embodiments, the turret socket track 410 accepts and orients the turret-style sockets 205 and closes off the channel wire way 415 disposed longitudinally and substantially along the center of the fixture 100. Further, the turret socket track 410 provides an attachment point 705 for the channel cover 415 and allows for attachment of the reflectors 305 and optional fixture side flanges 420. The optional side flanges 420 couple the two structural ends of the fixture 100 together creating a complete robust industrial product in torsion and stiffness without the need for a fully enclosed housing. The fixture 100 also provides easy access to the ballast area (a ballast is not shown) and internal wiring without the removal of the lamps 210 and reflectors 305. By providing access to the ballast area and also access to the wiring without the need to remove the lamps 210 or reflectors 305, maintenance on the fixture 100 related to wiring or ballast issues can be completed more quickly. The exemplary fixture can also include an optional wire guard and/or door frame. The optional wire guard and door frame are configured to aid in protecting the internal components of the fixture 100 as well as contain potential debris and prevent it from causing lamp breakage, should debris get into the fixture 100.

Figure 6:
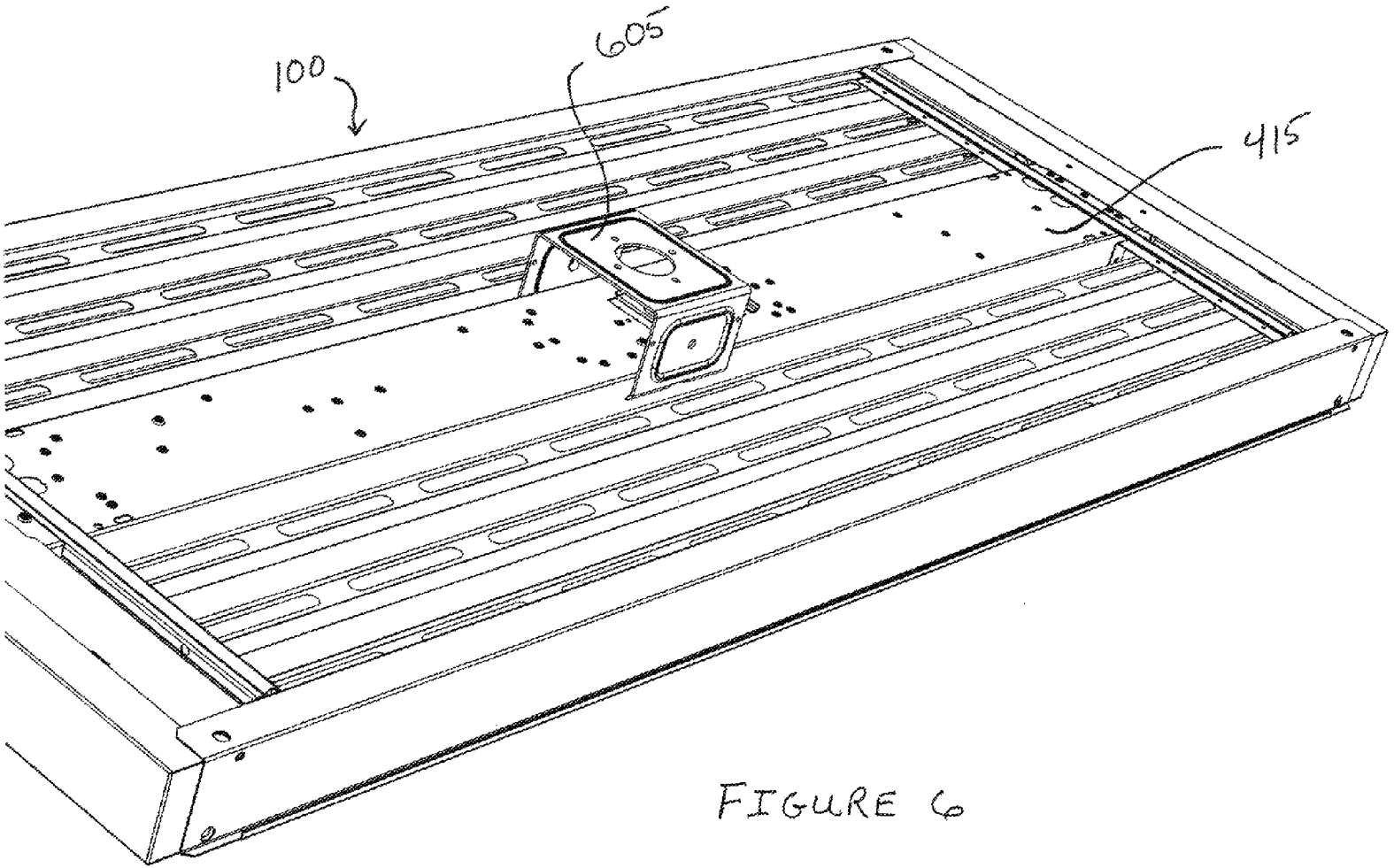
FIG. 6 is another partial perspective view of the fluorescent light fixture of FIG. 1 with a tong hanger system coupled thereto in accordance with another exemplary embodiment of the present invention.
Figure 7:
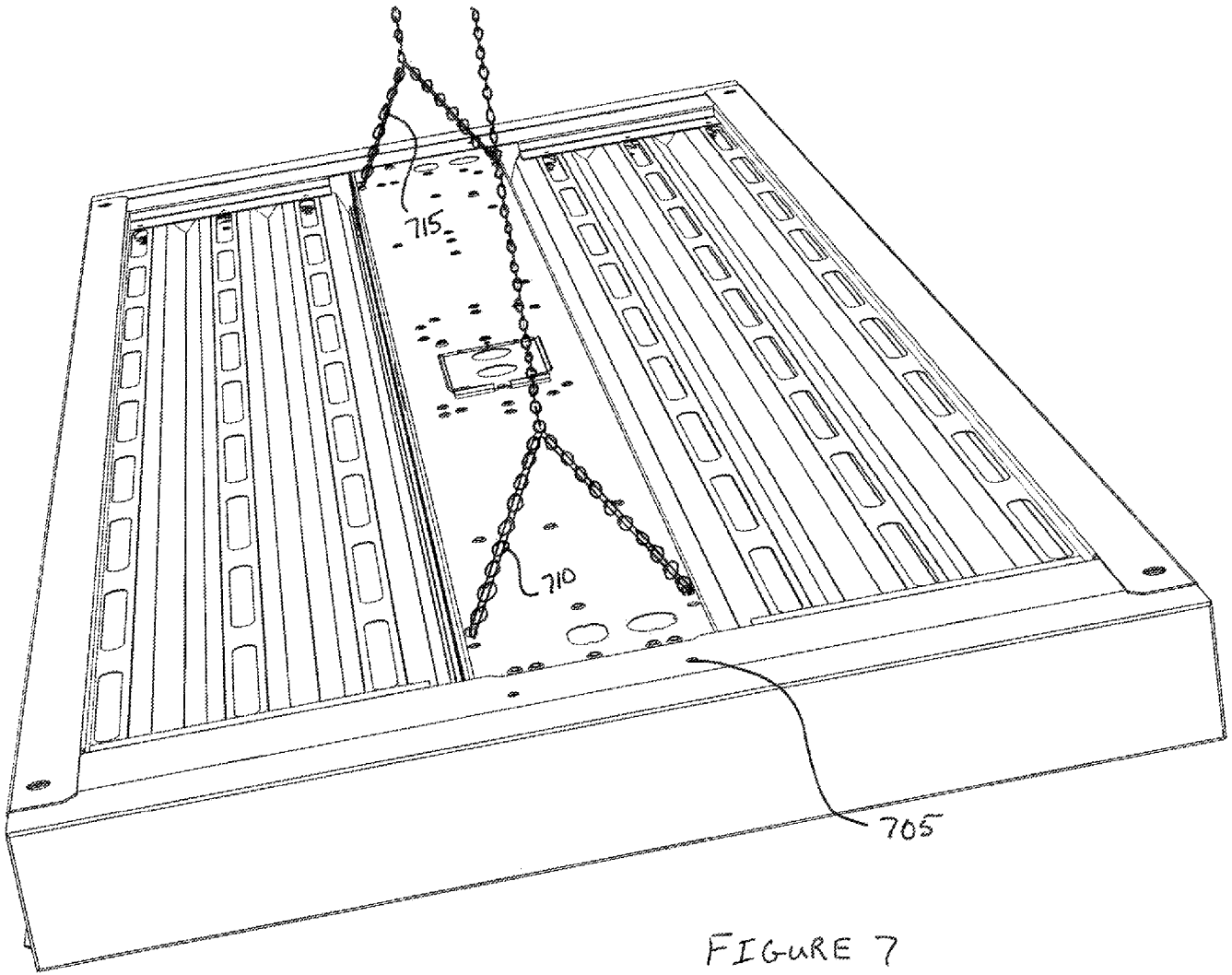
FIG. 7 is a perspective view of the fluorescent light fixture of FIG. 1 presenting an alternative chain hanger system coupled thereto in accordance with the exemplary embodiment of FIG. 1.
Figure 8:
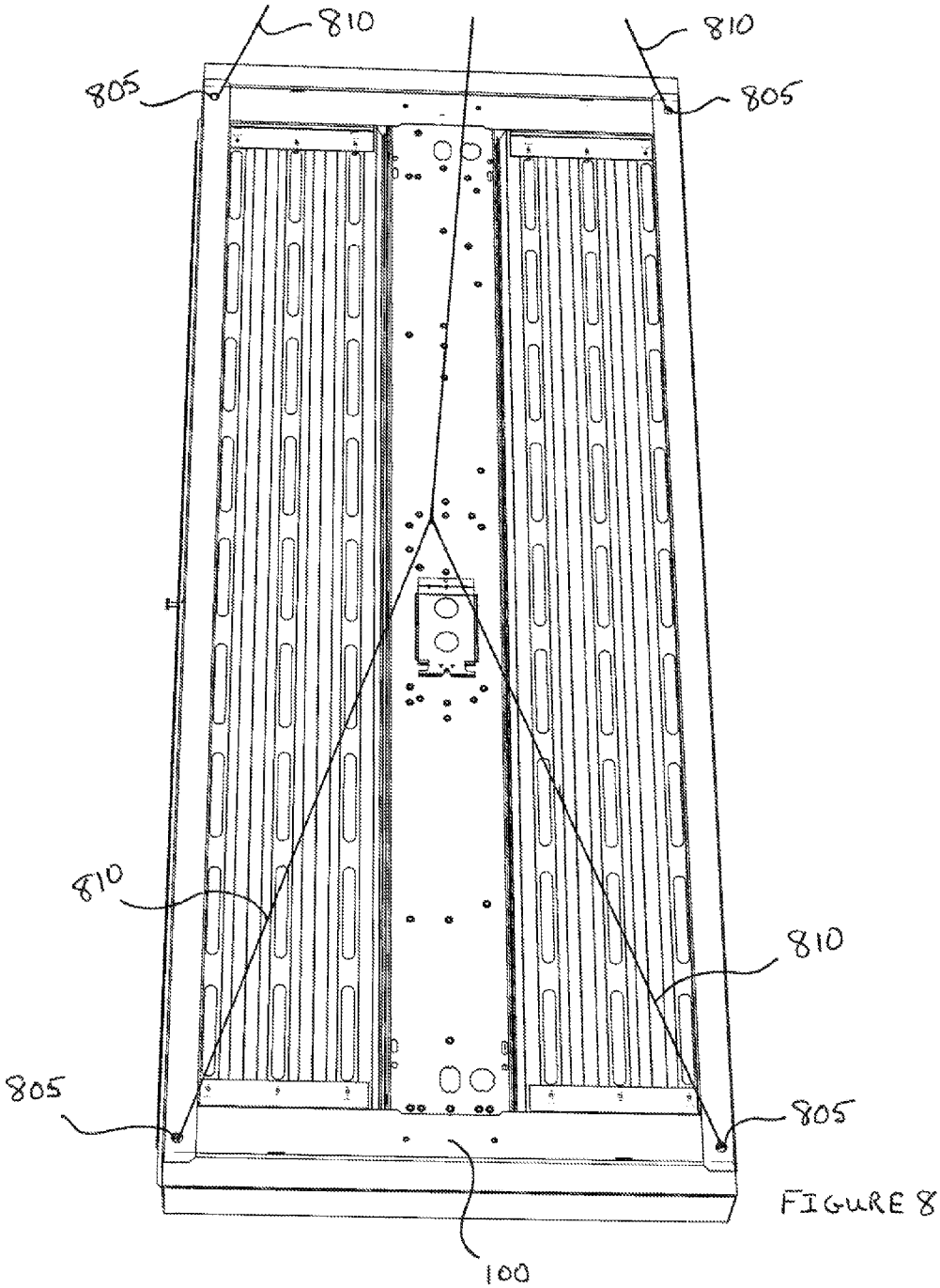
FIG. 8 is a perspective view of the fluorescent light fixture of FIG. 1 having an alternative Gripple hanger system in accordance with the exemplary embodiment of FIG. 1.

FIGS. 6-8 present three of many alternative hanging methods that can be used with the fixture 100. FIG. 6 presents a tong hanger 605 coupled to a portion of the channel 415 substantially near the longitudinal and latitudinal center of the fixture 100. FIG. 7 presents a pair of AYC chain hangers 710, 715 coupled to substantially opposing ends of the channel 415. FIG. 8 presents a Gripple hanger system that includes a pair of apertures 805 disposed along one end of the fixture 100 and one or a pair of wires 810 extending through the apertures 805. A Gripple system is provided for on both ends of the fixture. Further, while the exemplary embodiment shows the wires 810 from the same end coupled to one another, the hanging system can be modified such that the wires from the same longitudinal end of the fixture 100 are alternatively coupled to one another. In addition to the hanging methods shown in FIGS. 6-8, the exemplary fixture 100 can also be mounted or hung using a four-point stem mounting system (not shown) or any other hanging system known to those of ordinary skill in the art.

According to certain aspects of the invention, High-intensity Fluorescent (HIF) lamps may be used in the fixture. Depending on the particular application, any number of lamps may be used, in particular, 2, 4, 6, 8, or 10 lamp fixture configurations may be employed. One embodiment of the invention is a high bay fluorescent fixture for industrial applications, which provides for energy efficiencies compared to HID fixtures and other fluorescent fixtures. Some embodiments of the fixture may provide better light or energy efficiency. Embodiments of the fixture may also have photometrics and optical distribution, wherein light output is sufficiently great so that relatively fewer fixtures are required to illuminate spaces. Embodiments of the fixture for industrial applications may provide protection against airborne particulates, oil residues and/or chemical vapors. Lamps that may be used in a high bay industrial application with the turret-type sockets may include, for example, T8, T8HO (slim line), T5 and T5HO.

According to other aspects of the invention, a motion detector may be used with the high bay fixture to turn the fluorescent lamps on when motion is detected in the proximity of the fixture. A control circuit may also cause the lamps to remain on for a period of time after the motion has been detected and then switch the lamps off.

Another aspect of the exemplary embodiments is to provide a housing that encloses sockets for fluorescent lamps. The housing may entirely enclose the sockets so that only the portions of the sockets for receiving lamp electrodes are accessible through the housing. In one exemplary embodiment, the housing comprises a clam shell design wherein two halves of the housing mate together to form the enclosure. The two halves of the housing may be assembled by connecting first portions of the two halves and then rotating the two halves about the connection point so that the two halves are completely mated to form the enclosure.

Still another aspect of the invention is to provide a wireway enclosure for the fixture ballast and other electrical components and to provide a socket housing assembly wherein the wireway and socket housing assembly are open to each other so that electrical wires connect the ballast and other electrical components to the sockets without the wires or any of the electrical components being exposed outside the enclosures. In some exemplary embodiments, the wireway enclosure is configured in such a way that access to the interior of the wireway enclosure is achieved without disassembly of fixture components and fluorescent lamps. In particular, a cover is removed to give access to the ballast and other wiring without removing the fluorescent lamps.

Exemplary embodiments may also include reflectors that reflect and focus light emitted by the fluorescent lamps so that the fixture may be mounted in high bay applications, i.e., higher than 20 feet from the floor, and the area of illumination on the floor of the high bay environment is increased, the intensity of light that reaches the floor is increased or a combination of both. In certain exemplary embodiments the reflectors may be mounted directly to the socket housing.

FIG. 1 illustrates a perspective view of a fixture 100 in a fully assembled configuration. The fixture 100 comprises a wireway 20, two socket housings 30, two reflectors 60, and two side flanges 70. In the view shown in FIG. 1, the front and a side of the fixture 100 are shown so that the reflective side of the reflectors 60 and sockets 33 and 34 are visible.

Figure 9:
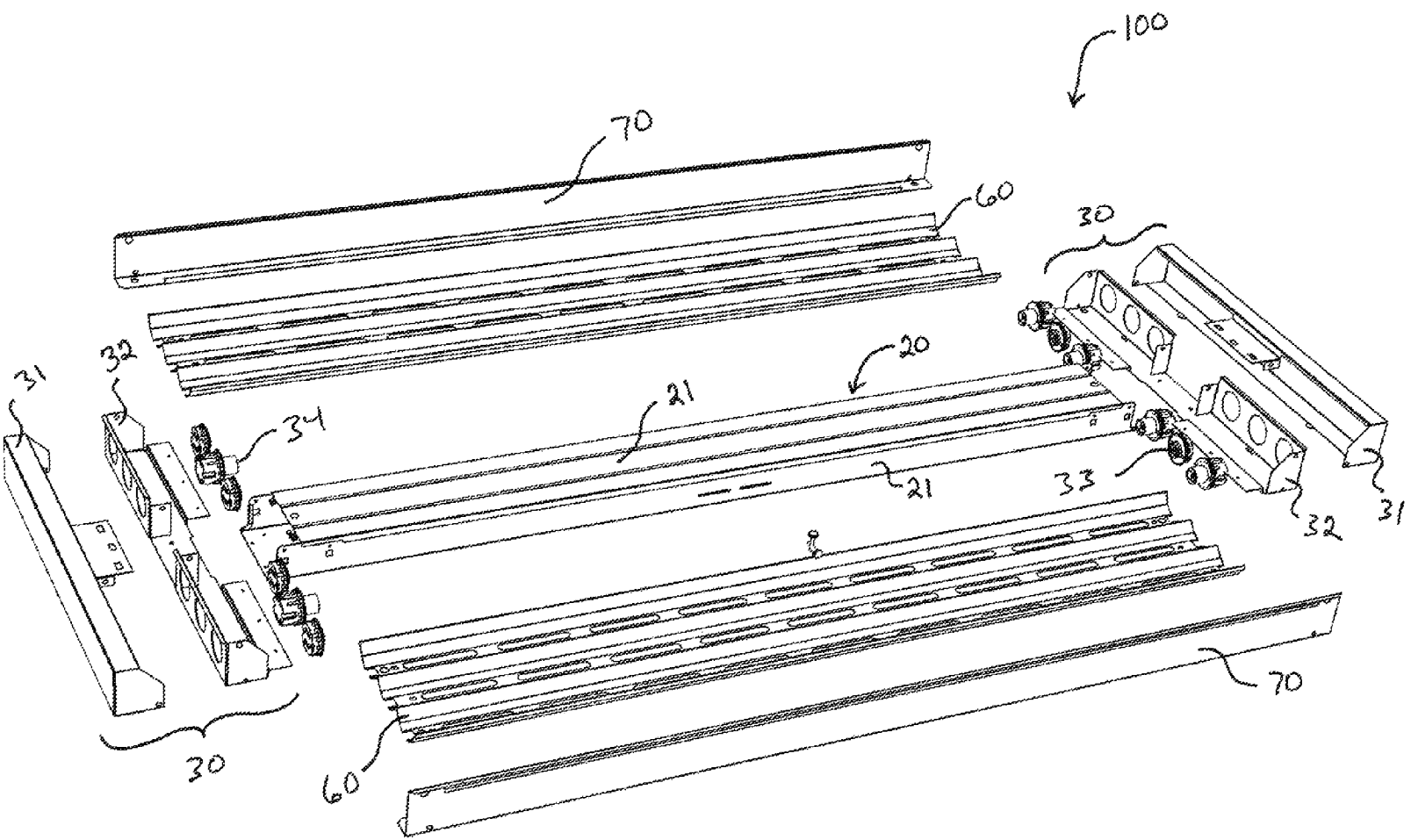
FIG. 9 is a perspective exploded view of a fixture.

FIG. 9 is an exploded perspective view of the fixture 100 shown in FIG. 1. The socket housings 30 each comprise an end cap 31 and a socket track 32. In the embodiment shown, six pairs of turret-type sockets are provided. Each socket pair has a female socket 33 and a male socket 34. In the exemplary embodiment of FIG. 9, the wireway 20 is comprised of a channel 21 and a channel cover 22. Two separate reflectors 60 are also provided. Finally, two side flanges 70 extend along the sides of the fixture 100.

Figure 10A:
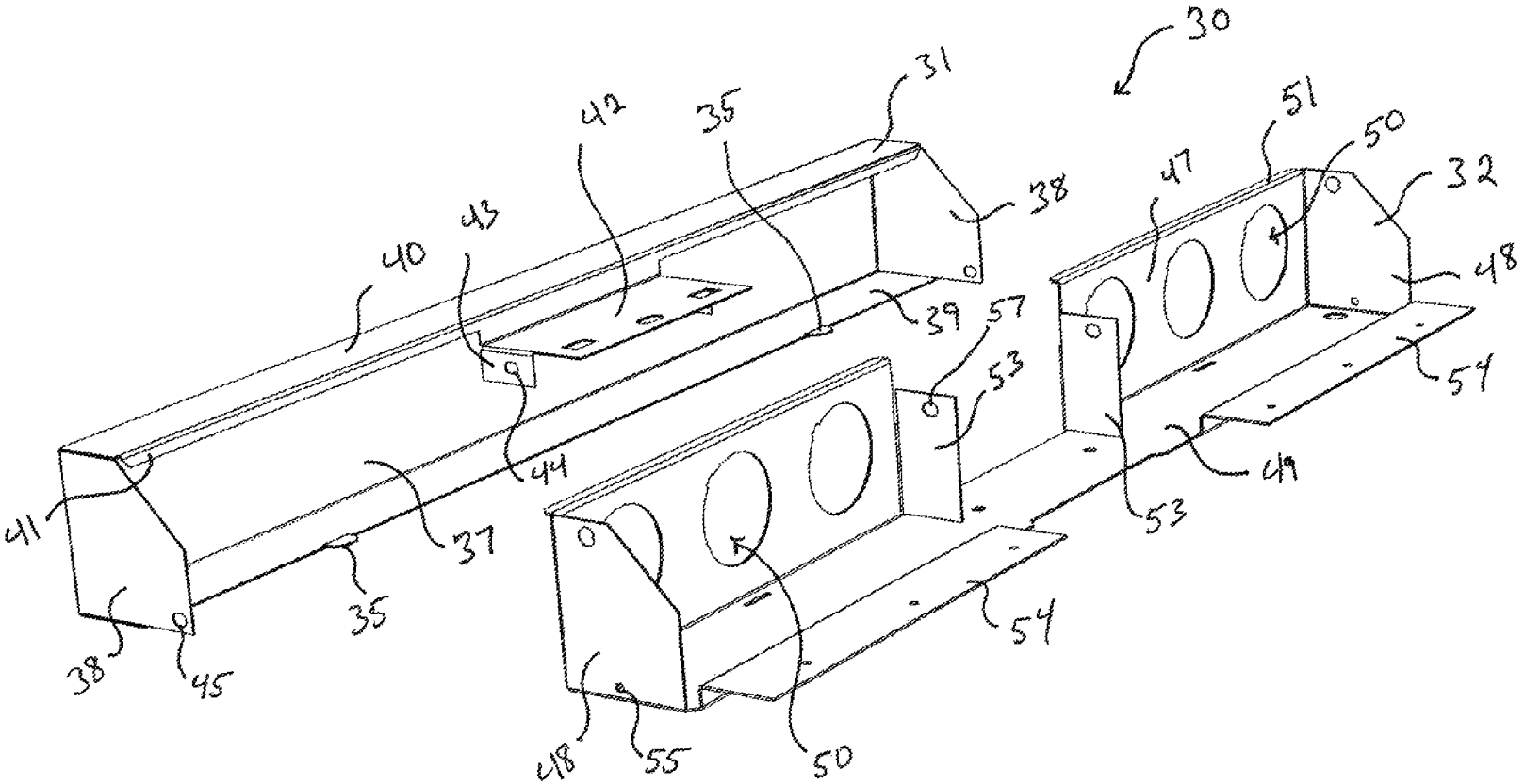
FIG. 10A is an exploded view of a socket housing comprising an end cap and a socket track wherein the view is from the perspective looking into the socket track and endcap.

Referring to FIG. 10A, an exploded perspective view of a socket housing 30 is illustrated. The socket housing comprises an end cap 31 and a socket track 32. In one exemplary embodiment, the end cap 31 and socket track 32 are bent from separate stamped pieces of sheet metal. The end cap 31 has an end wall 37, two side walls 38, a back wall 39 and a front wall 40. The side walls 38 are perpendicular to the end wall 37. Similarly, the back wall 39 and the front wall 40 are perpendicular to the end wall 37. Thus, the walls are formed together so as to form a box that is open at one side. The distal edge of the back wall 39 has two tabs 35. The front wall 40, at its distal edge, has a lip 41 that extends the entire length of the front wall 40. In the middle of the front wall 40, a cover plate 42 extends in a direction parallel to the front wall 40. On each side of the cover plate 42, a flange tab 43 extends in a direction parallel to the side wall 38.

The socket track 32 shown in FIG. 10A, comprises an end wall 47, two side walls 48, and back wall 49. The side walls 48 and the back wall 49 are perpendicular to the end wall 47. At the distal edge of the end wall 47, a lip 51 extends in a perpendicular direction from the end wall 47 in a direction opposite the side walls 48. In the exemplary embodiment shown, the end wall 47 has six socket holes 50 for receiving turret-type sockets. The end wall 47 also has two flange tabs 53 that extend from a central portion of the end wall 47 in a direction perpendicular to the end wall 47. It should be noted that, in one exemplary embodiment, the central portion of the end wall 47 is completely absent between the flange tabs 53. At the distal edge of the back wall 49, there are two reflector mounting flanges 54. The reflector mounting flanges 54 extend in a direction parallel to the back wall 49. However, the reflector mounting flanges 54 do not lie in the same plane as the back wall 49, but rather they are off-set in the direction of end wall 47.

Figure 10B:
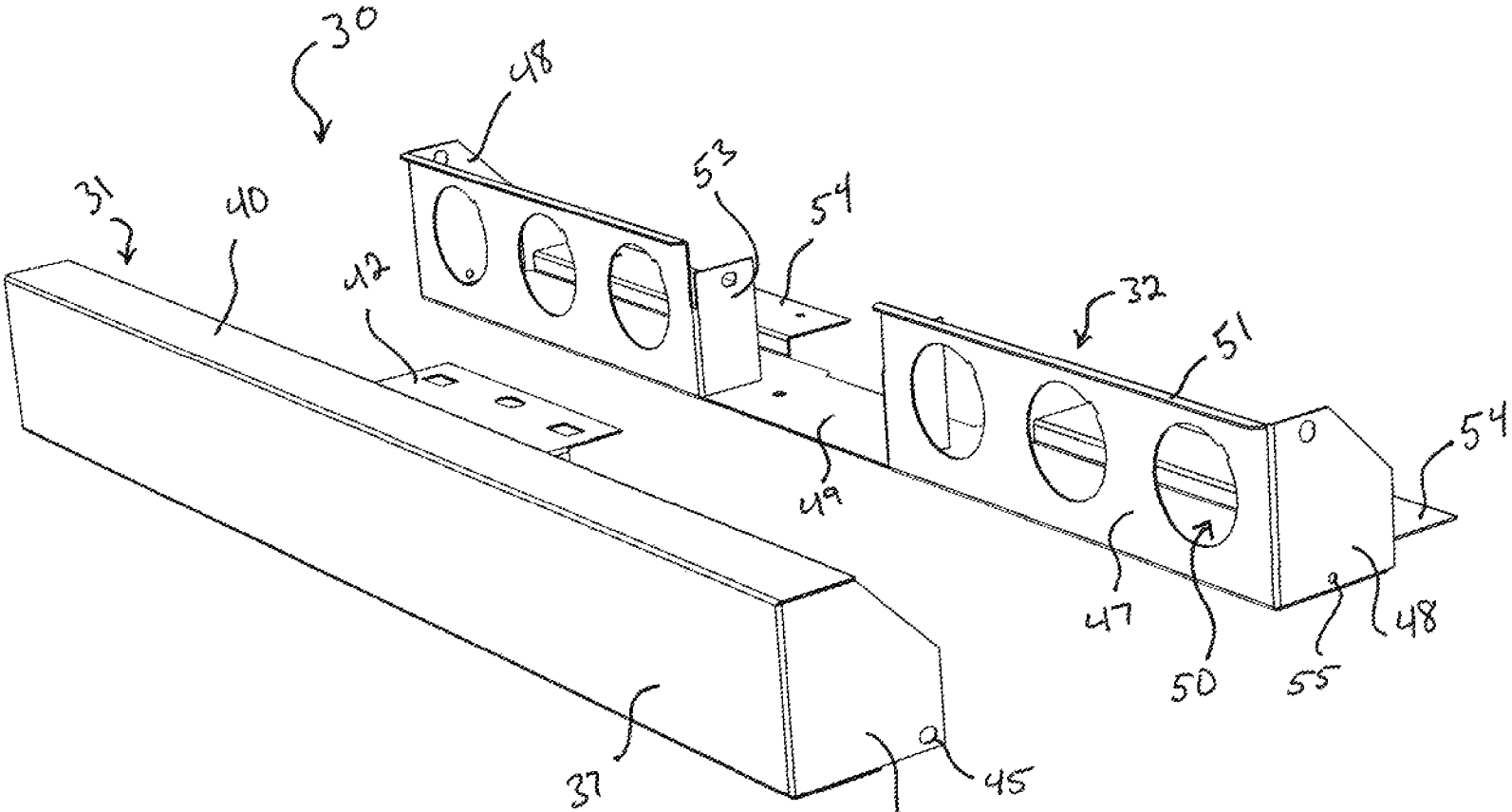
FIG. 10B is an exploded view of the socket housing of FIG. 10A, wherein the view is from the perspective looking at the outside of the end cap.

Referring to FIG. 10B, a perspective view of the disassembled socket housing of FIG. 10A is shown from the view of the outside of the end cap 31. As previously discussed, the end cap 31 has front wall 40, two side walls 38, and a back wall 39 (not shown) that extend in directions perpendicular to the end wall 37. The cover plate 42 can be seen extending beyond the front wall 40 of the end cap 31. The socket track 32 is shown in this view with its six different socket holes 50 in the end wall 47. As previously described, a back wall 49 and two side walls 48 extend in directions perpendicular to the end wall 47.

Figure 10C:
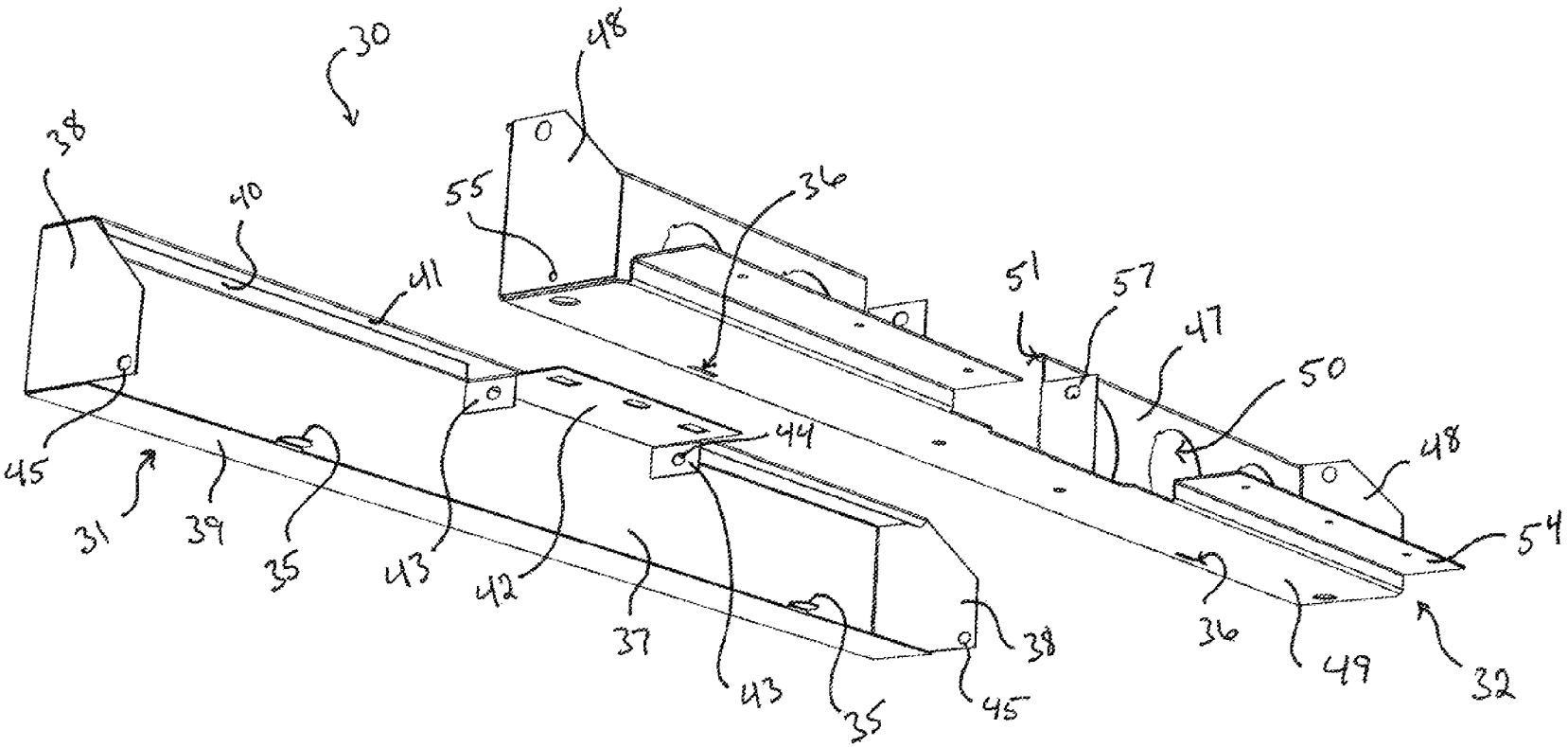
FIG. 10C is an exploded view of the socket housing of FIGS. 10A and 10B wherein the view is of the tab on the end cap and slits or tab slots in the socket track.

Referring FIG. 10*c*, a perspective view of the socket housing 30 of FIGS. 10A and 10B is shown from a view toward the exterior of the back wall 39 and 49. From this view, it is clearly shown how the reflector mounting flanges 54 are offset from the back wall 49 of the socket track 32. Further, in this view it is clearly shown how the tabs 35 of the end cap 31 align for engagement with the slits or tab slots 36 of the socket track 32. Referring to FIGS. 10A through 10C, it should be noted that the socket housing 30 is formed by assembling to each other the end cap 31 and the socket track 32. In particular, the tabs 35 of the end cap 31 are inserted into the slits or tab slots 36 of the socket track 32. With the tabs 35 inserted in the slits or tab slots 36, the socket track 32 is rotated toward the end cap 31 until the lip 51 of the socket track 32 is positioned immediately behind the lip 41 of the end cap 31. In an embodiment, the height of the end wall 47 of the socket track 32 is slightly larger than the window formed by the back wall 39 and lip 41 of the end cap 31, so that the end cap 31 must be expanded slightly so as to receive the socket housing and allowing the end cap to resiliently embrace the socket cap 32. Once assembled, the socket housing 30 provides an enclosure for receiving turret-type sockets. In some manufacturing processes, the sockets 33, 34 and wiring may already be installed when the end cap 31 is attached to the socket track 32.

Figure 11A:
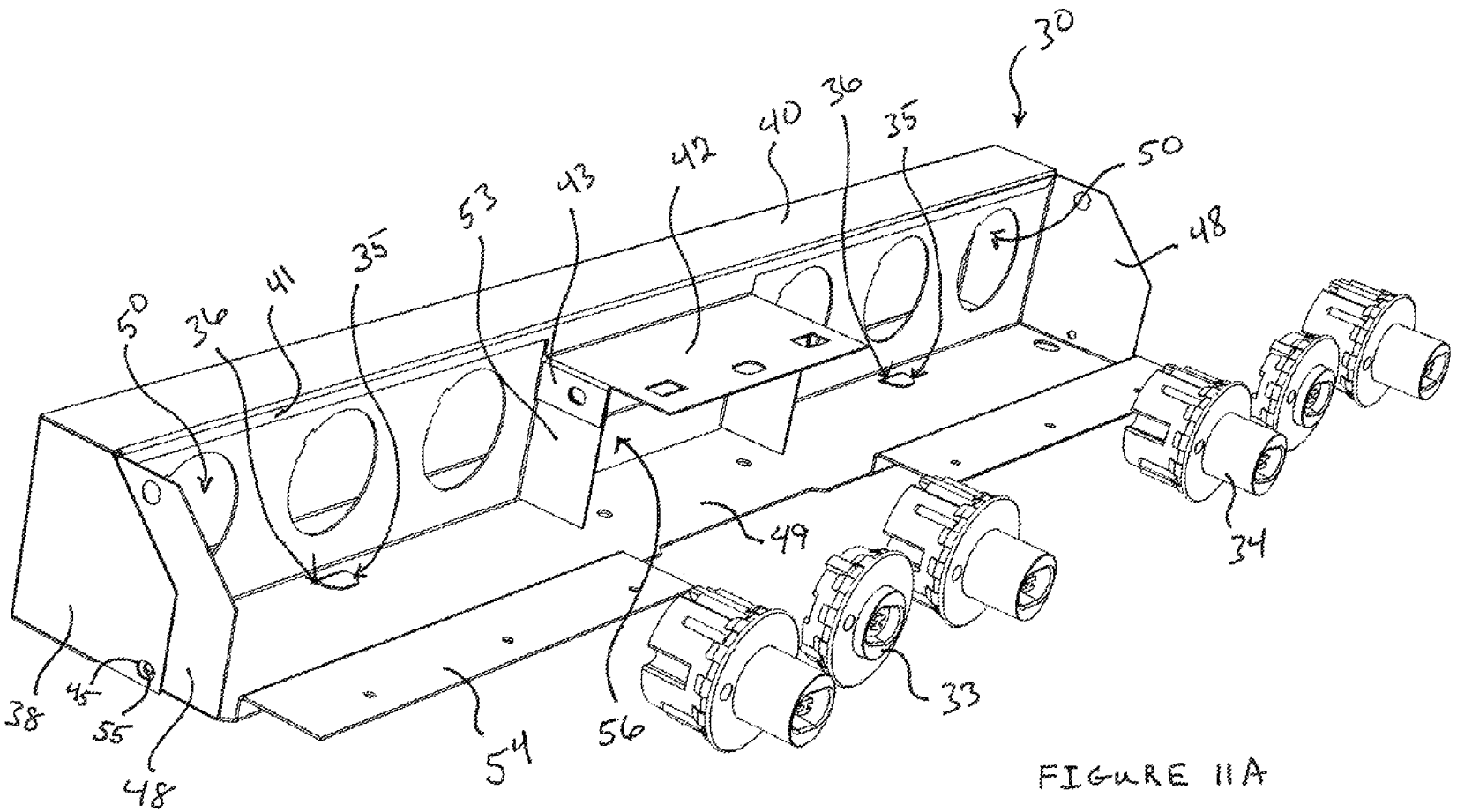
FIG. 11A is a perspective of the socket housing, wherein the end cap and socket track are assembled, wherein sockets are shown in an exploded view.
Figure 11B:
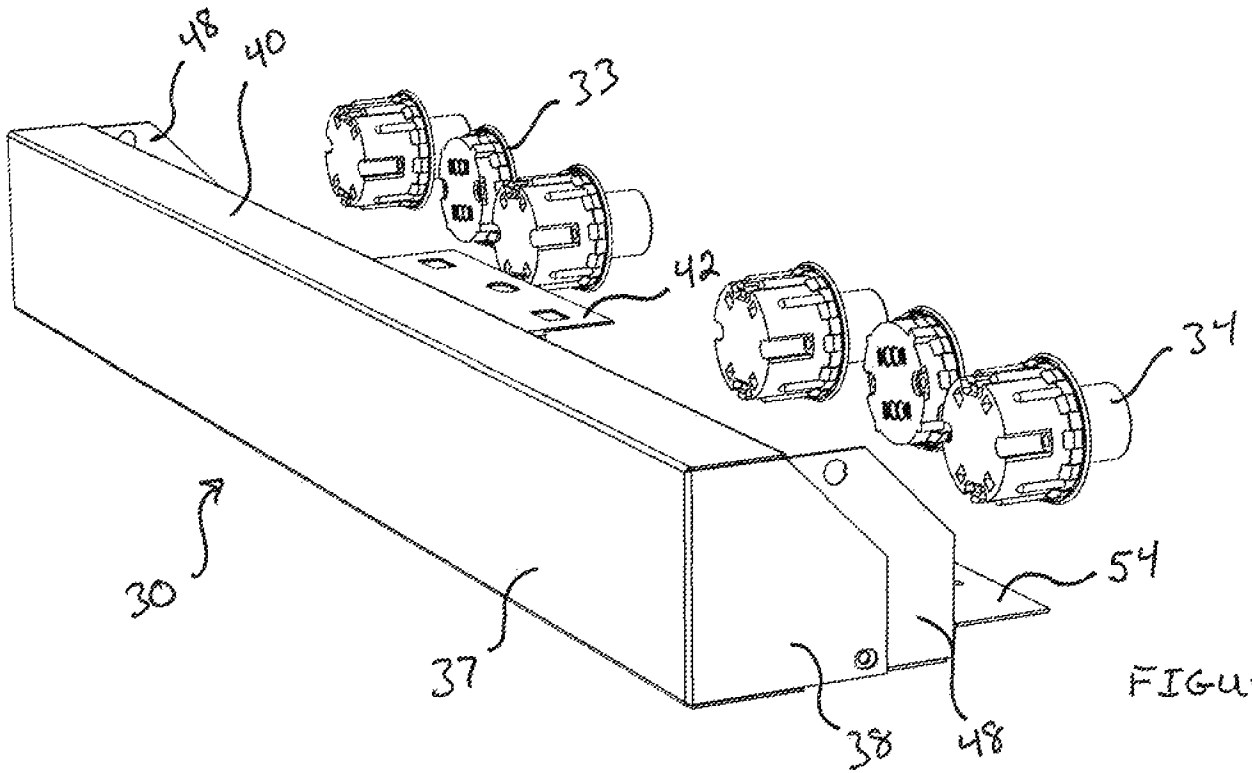
FIG. 11B is a perspective view of the assembled socket housing shown in FIG. 11A, wherein the view is of the outside of the end cap.
Figure 11C:
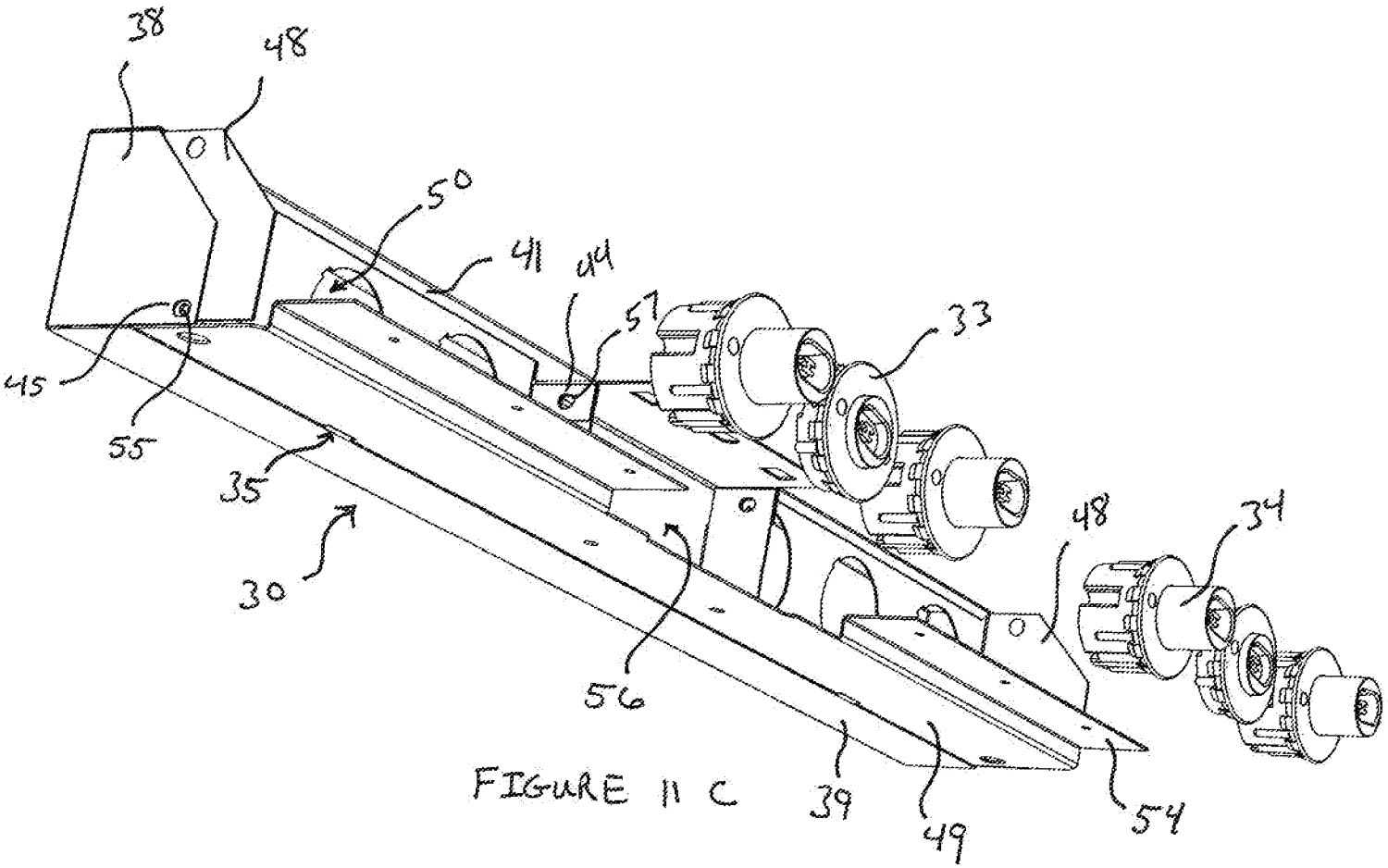
FIG. 11C is a perspective view of the assembled socket housing, wherein the view is of the end cap tabs and socket track slits or tab slots.
Figure 12:
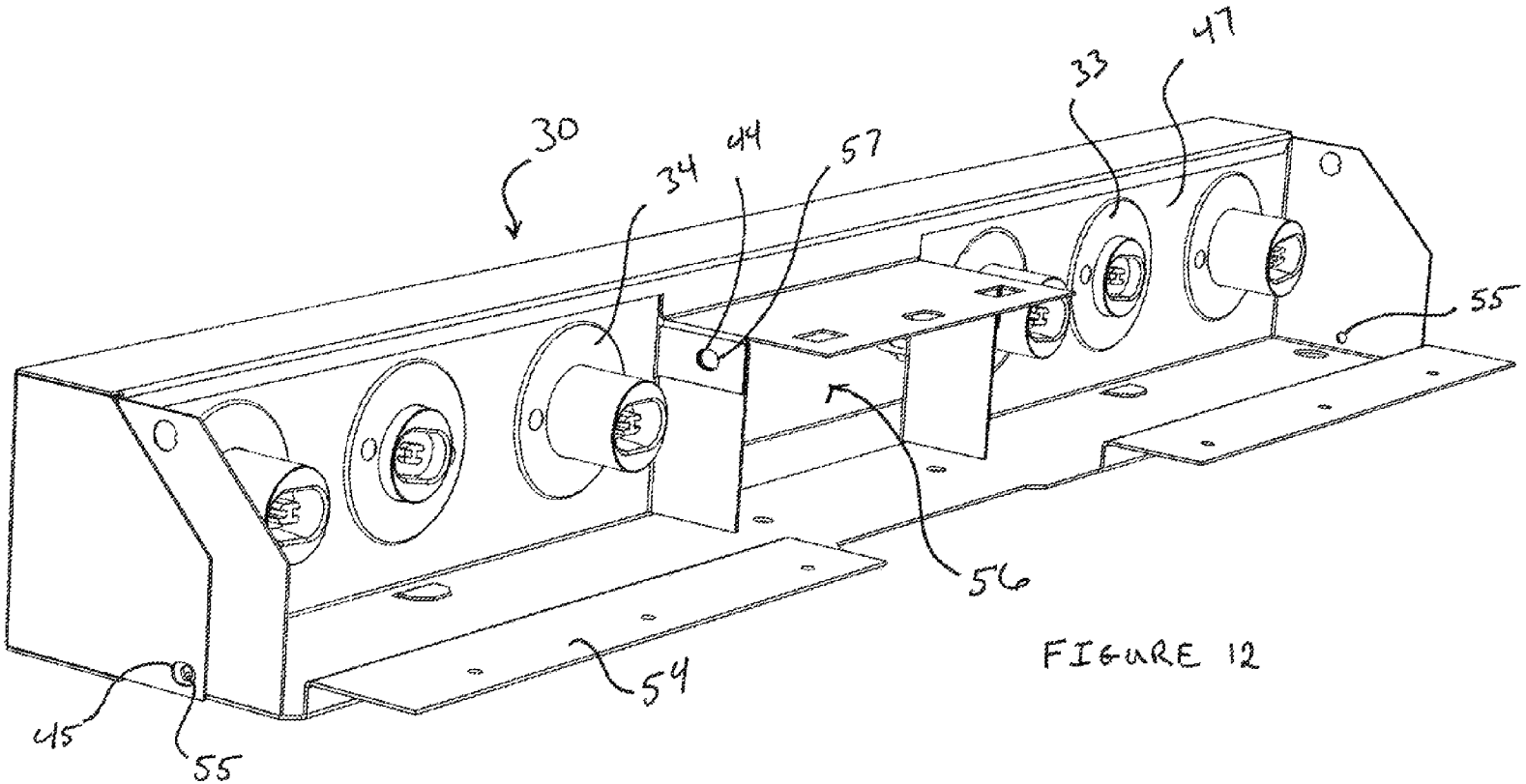
FIG. 12 is a perspective view of a socket housing wherein sockets are assembled into the socket housing assembly.

Referring to FIGS. 11A through 11C, perspective views of a fully assembled socket housing 30 are illustrated. The tabs 35 are extended through the slits or tab slots 36 and the lip 51 (not shown) of the socket track 32 is immediately behind the lip 41 of the end cap 31. The side walls 48 of the socket track 32 are immediately inside the side walls 38 of the end cap 31. Similarly, a portion of the flange tab 53 of the socket track 32 is immediately inside flange tab 43 that extends from the cover plate 42 of the end cap 31. When fully assembled, an opening into the interior of the socket housing 30 is formed by the back wall 49, flange tabs 53, and cover plate 42. For purposes of this disclosure, this opening will be identified as a wireway opening 56. Flange tabs 53 also creates a bent edge relative to end wall 47, rather than a sharp edge, which may protect wires from being cut when exiting the channel wire way opening 56 (see FIG. 11A) and into the socket housing assembly. As shown in FIGS. 11A through 11C, turret-type sockets are inserted into the socket holes 50 of the socket housing 30. Female sockets 33 and male sockets 34 are illustrated. Referring to FIG. 12, a fully assembled socket housing 30 is illustrated with male and female sockets mounted therein. The socket housing 30 has a wireway opening 56 for connection to a wireway (not shown). Female sockets 33 and male sockets 34 are mounted in the end wall 47 of the socket housing 30. The socket housing 30 also includes reflector mounting flanges 54.

In some exemplary embodiments, the end cap 31 and socket track 32 form-fit together so that no fasteners are required to hold or fix the assembled parts relative to each other. In the embodiment illustrated in FIGS. 10A through 11C, metal screw-type fasteners are inserted into end cap side holes 45 and socket track side holes 55, after the end cap 31 and socket track 32 are assembled to align the holes as best seen in FIG. 11A. Similarly, metal screw-type fasteners are inserted into cover plate flange tab holes 44 and socket track flange tab holes 57, after the end cap 31 and socket track 32 are assembled to align the holes as best seen in FIG. 11C. Alternatively, any fastening means known to persons of skill may be used, but one consideration is to ensure that the fastening means are U/L compliant pertaining to fasteners intruding into the wireway.

Figure 13A:
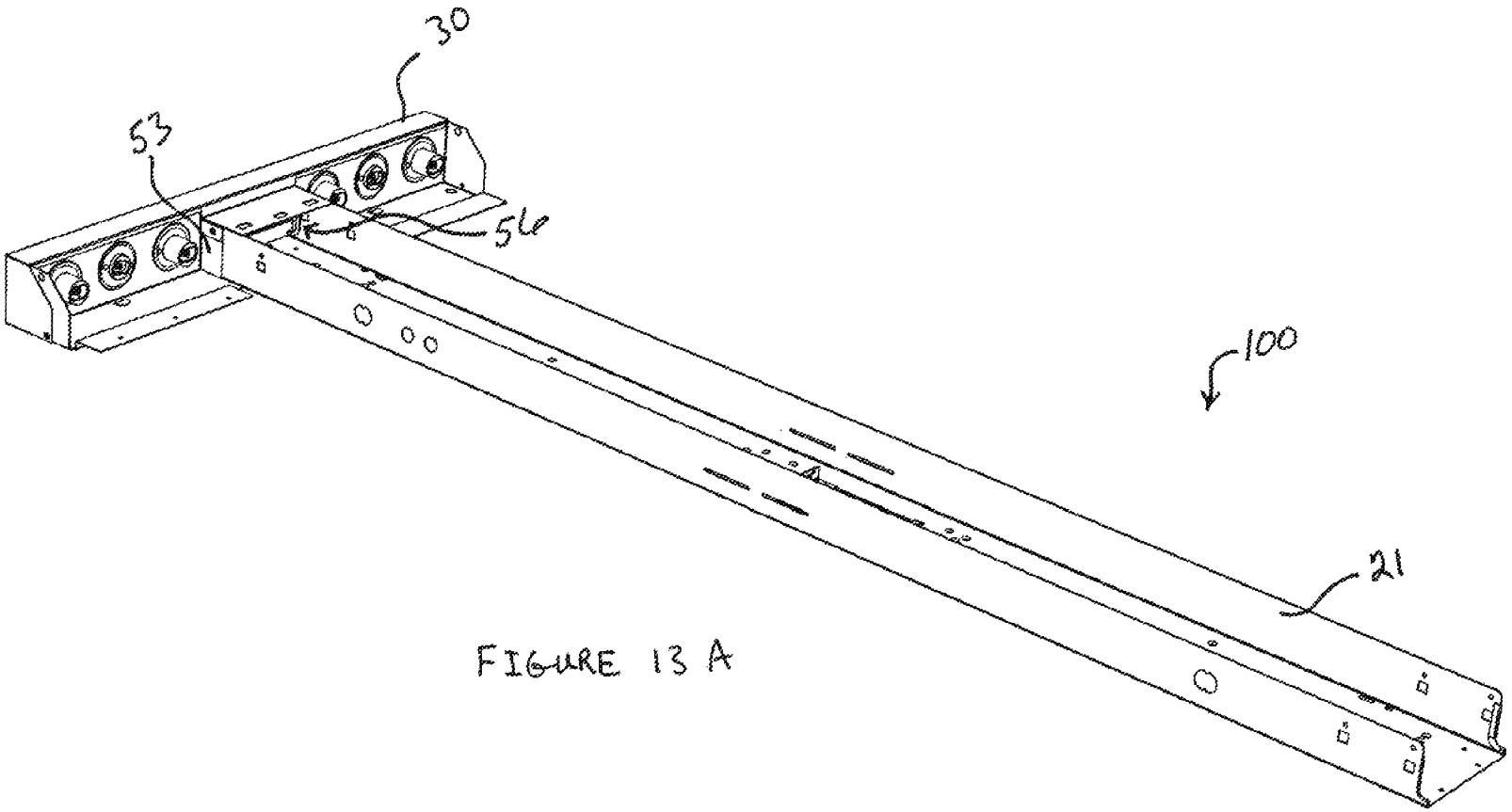
FIG. 13A is a perspective of a channel wire way and a socket housing assembled thereto.
Figure 13B:
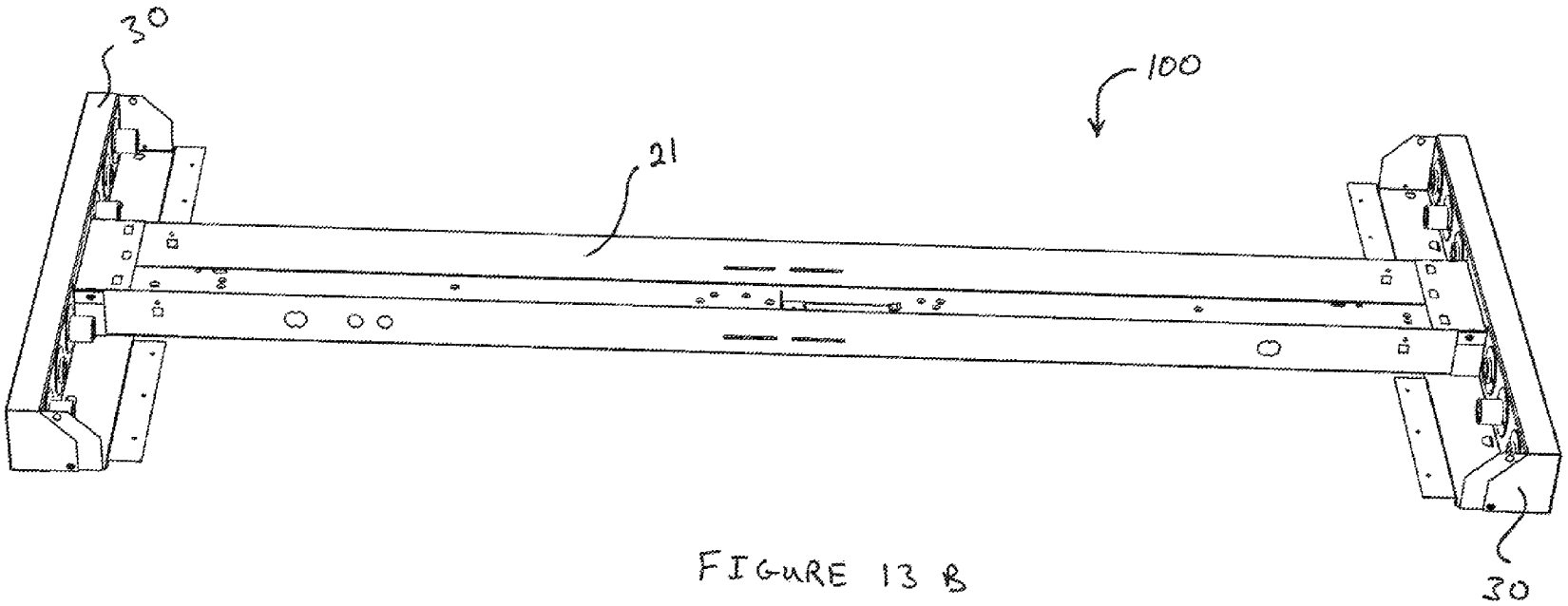
FIG. 13B is a perspective view of a wire way channel with a first socket housing attached or assembled to one end of the wire way channel and second socket housing assembled to a second end of the wire way channel.

Referring to FIGS. 13A and 13B, the backbone structure of the fixture 100 is illustrated. As shown in FIG. 13A, a channel 21 is inserted into the wireway opening 56 of a socket housing 30. The channel 21 is inserted into the wireway opening 56 until the end of the channel 21 is positioned between flange tabs 53 of the socket housing 30. As shown in FIG. 13B, the backbone of the fixture 100 is completely assembled when a first socket housing 30 is attached to one end of the channel 21 and a second socket housing 30 is attached the opposite and of the channel 21. In the illustrated embodiment, metal screw-type fasteners are inserted into cover plate flange tab holes 44, socket track flange tab holes 57, and holes in the sides of the channel 21 to secure the channel 21 to the socket housing 30, as best seen in FIGS. 12 and 13A. Additionally, fasteners (not shown) may be installed through the back wall 39 of the end cap 31 or the back wall 49 of the socket track 32 and into the back wall of the channel 21. Alternatively, any fastening means known to persons of skill may be used, but one consideration is to ensure that the fastening means are U/L compliant pertaining to fasteners proximate wiring.

Figure 14A:
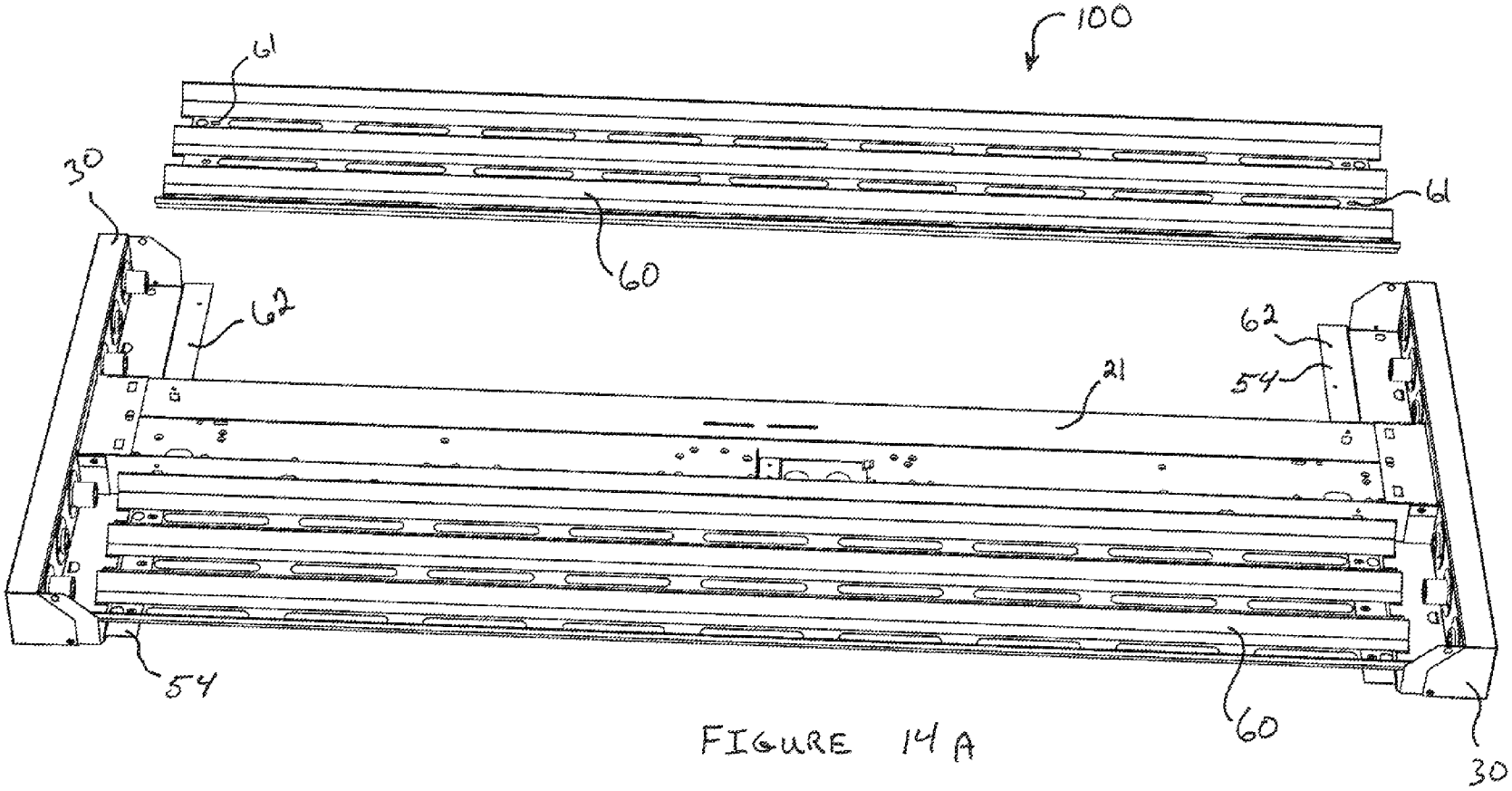
FIG. 14A is a perspective view of two reflectors, wherein one reflector is fully assembled to the socket housing assemblies and a second reflector is shown in an exploded view.

Referring FIG. 14A, assembly of reflectors to the fixture 100 is illustrated. The reflector 60 is mounted to each side of the fixture 100. In particular, each end of a fixture is positioned immediately adjacent to reflector mounting flanges 54 on the socket housing 30. Reflector holes 51 in the reflector 60 are made to align with flange hole 62 in each of the socket housings 30 so as to allow screw-type fasteners to be inserted through the holes to fasten the reflector 60 to the socket housings 30. Alternatively, any fastening means known to persons of skill may be used, but one consideration is to ensure that the fastening means are U/L compliant pertaining to fasteners proximate wiring. As illustrated, the reflectors 60 are positioned relative to the turret-type sockets of the socket housings 30 so as to reflect light emitted from fluorescent lamps that will be inserted into the sockets. As shown in FIG. 14A, with the reflectors 60 mounted directly to the socket housings 30, the fixture 100 may have increased stability and rigidity.

Figure 14B:
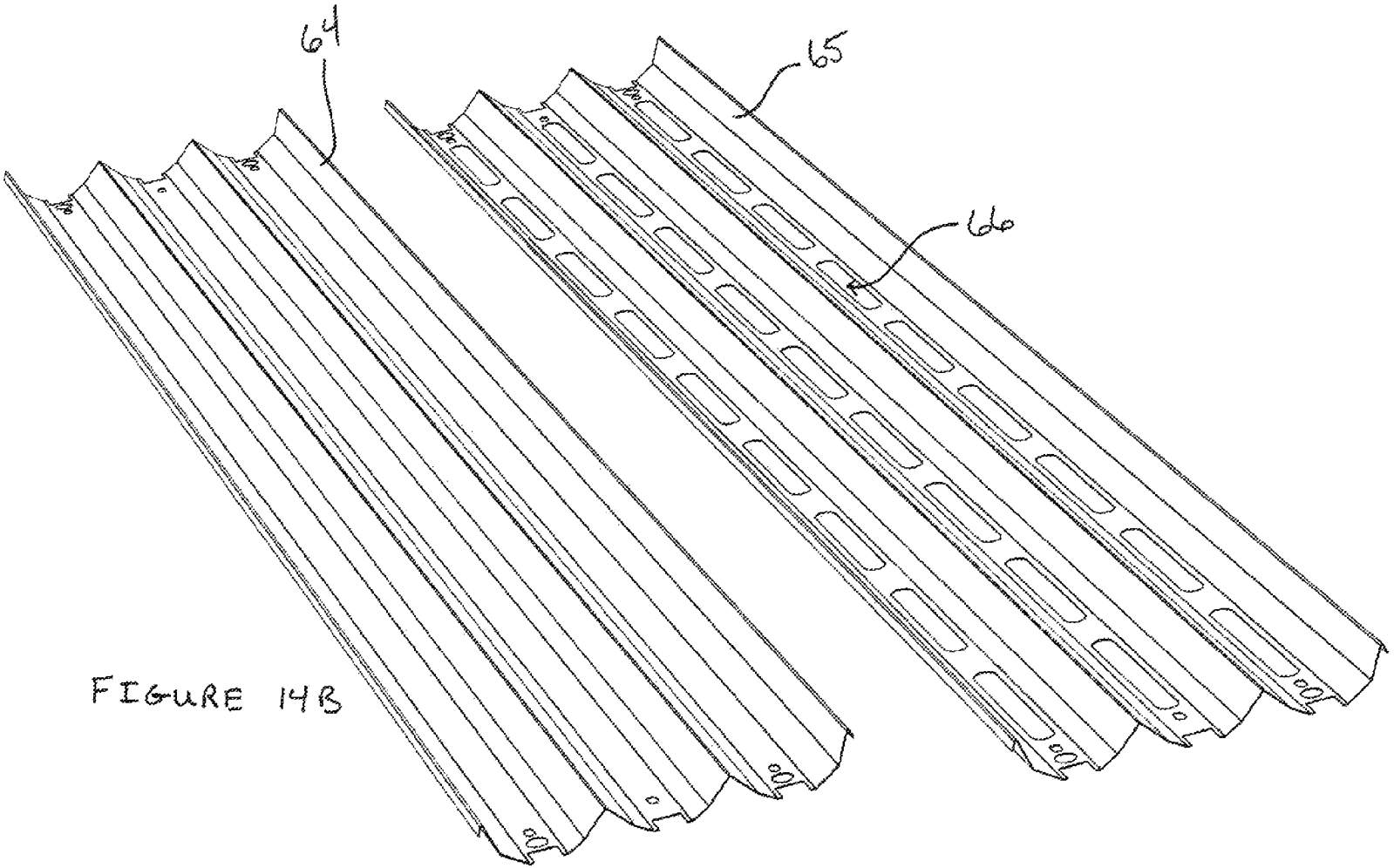
FIG. 14B is a perspective view of two reflectors, wherein one reflector is a solid form reflector and the other is a perforated form reflector for up light.

Turning to FIG. 14B, two different reflectors are illustrated. A solid-form reflector 64 provides maximum reflectivity but may also retain heat. Perforated-form reflector 65 has perforations 66 such that its reflectivity may be slightly less than what the reflectivity would be for a solid-form reflector 64, but the perforations 66 allow for heat to dissipate from the reflector and are used for up-light applications. The reflectors may utilize a Zenoptic or X-FORM reflective material, by Cooper Industries. The reflectors may be made of silver reflective material called Specular, Semi-Specular or micro-matte finish, or painted white.

Figure 15A:
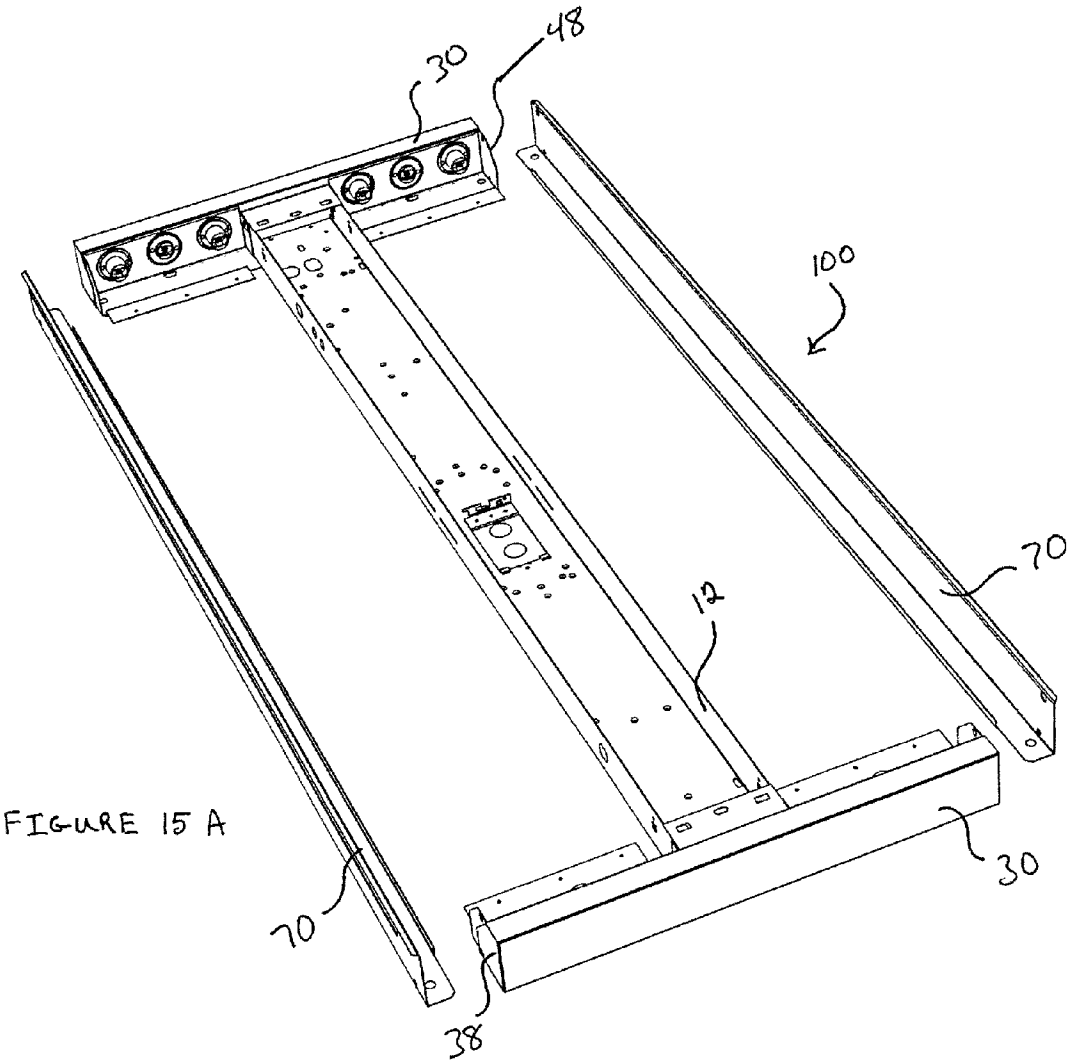
FIG. 15A is a perspective view of a wire channel way with two assembled socket housings, and two side flanges shown in an exploded view.
Figure 15B:
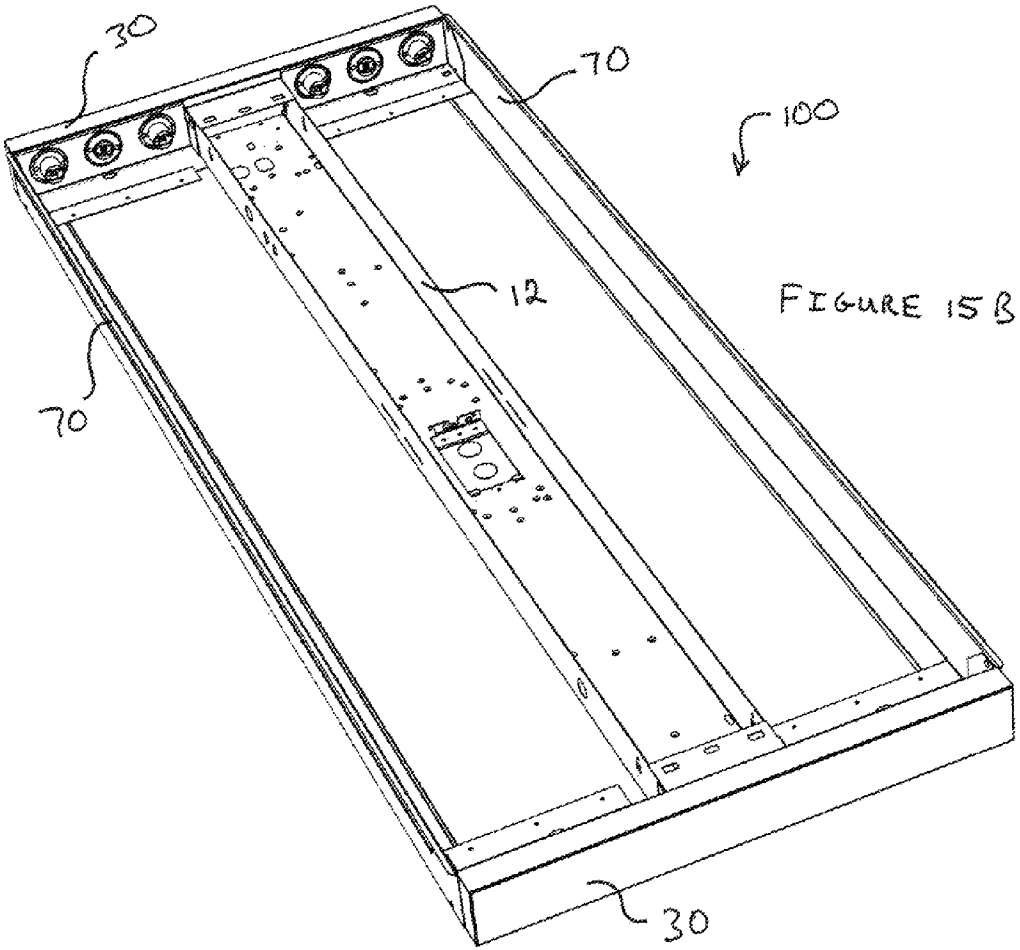
FIG. 15B is a perspective view of the fixture shown in FIG. 15A, wherein the side flanges are assembled to the distal ends of the socket housing assemblies.

Referring to FIGS. 15A and 15B, assembly of the side flanges to the fixture is illustrated. The side flanges 70 are mounted directly to the side walls 38 and 48 of the socket housings 30. While the side flanges 70 may be mounted to the fixture 100 by any means known to persons with skill in the art, in one exemplary embodiment, a screw-type fastener is inserted through holes in the side flanges 70 and into end cap side holes 45 and socket track side holes 55 of the socket housing 30. Alternatively, any fastening means known to persons of skill may be used. As shown in FIG. 15B, with the side flanges 70 mounted directly to the socket housings 30, the fixture 100 may have increased stability and rigidity.

Figure 16A:
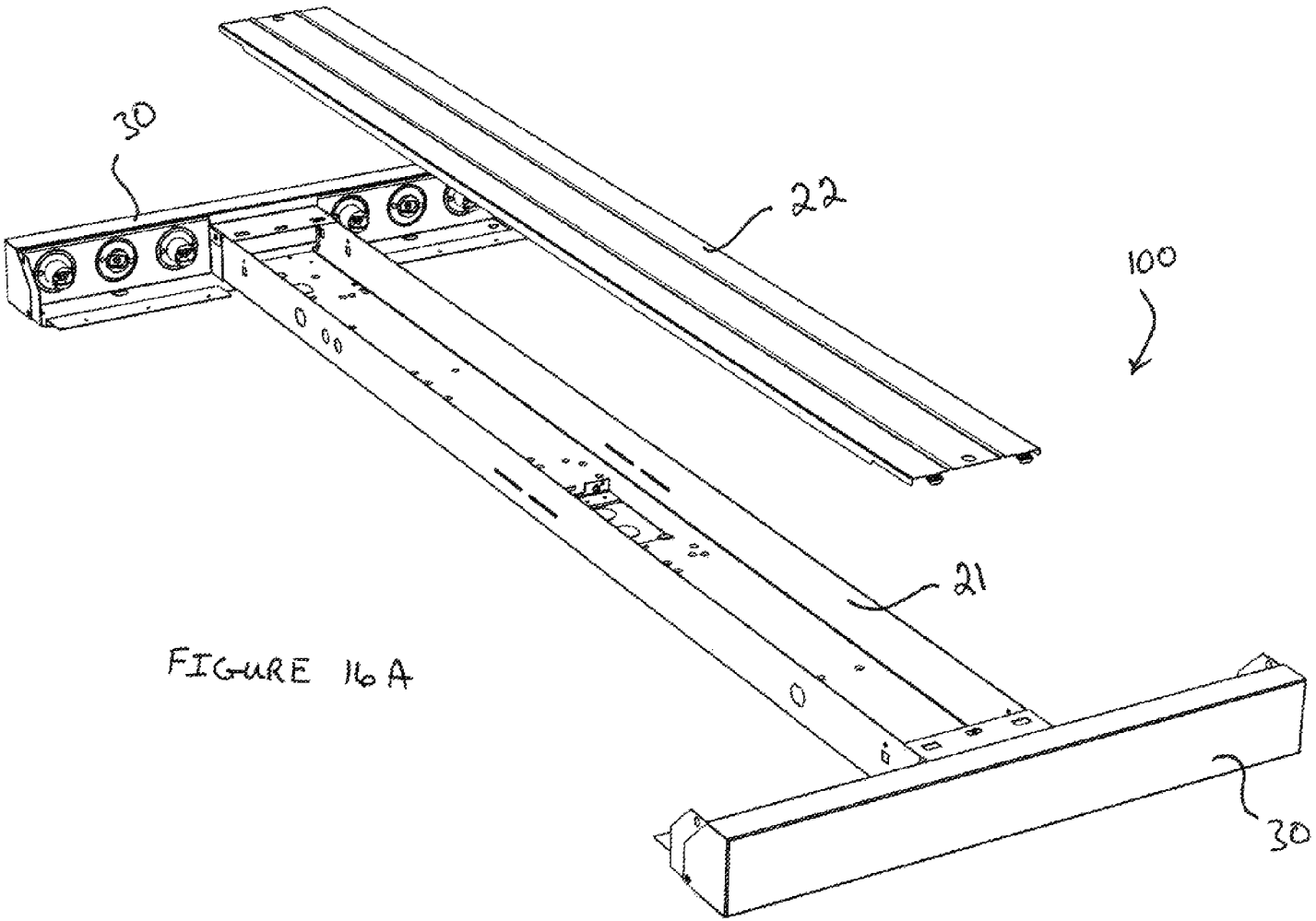
FIG. 16A is a perspective view of a wire way channel with two socket housings assembled thereto, and a channel cover shown in a exploded view.
Figure 16B:
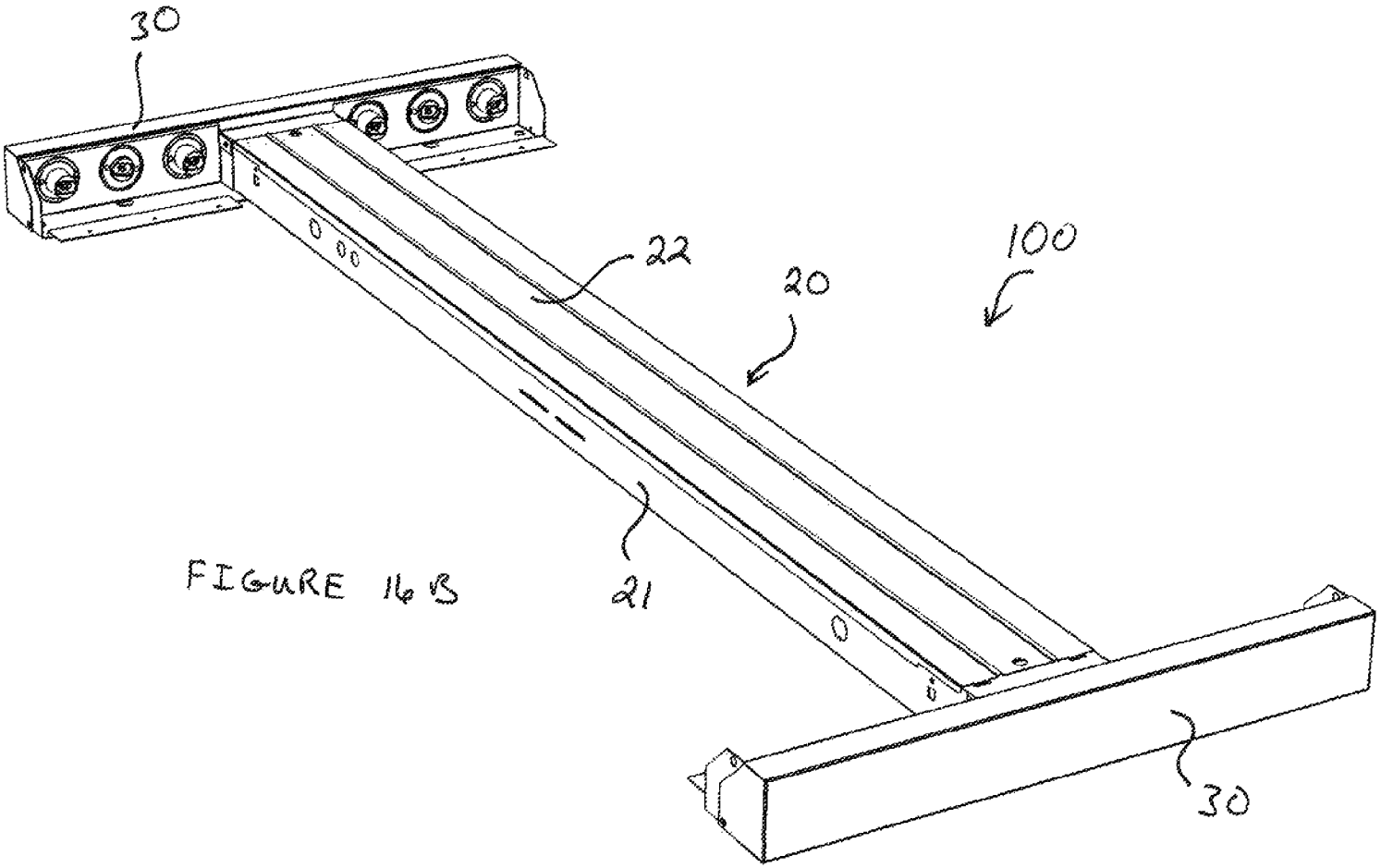
FIG. 16B is a perspective view of the fixture in FIG. 16A, wherein the channel cover is assembled to the channel of the wire way.

Referring to FIGS. 16A and 16B, assembly of a wireway is illustrated. The wireway 20 is comprised of a channel 21 and a channel cover 22. As previously described, the channel 21 extends between two socket housings 30 to form the backbone of a fixture 100. In FIG. 16A, the channel cover 22 is shown in an exploded view, while in FIG. 16B, the channel cover 22 is assembled to the channel 21 to form the wireway 20. Components of the fixture 100 may be contained within the wireway 20.

Figure 17:
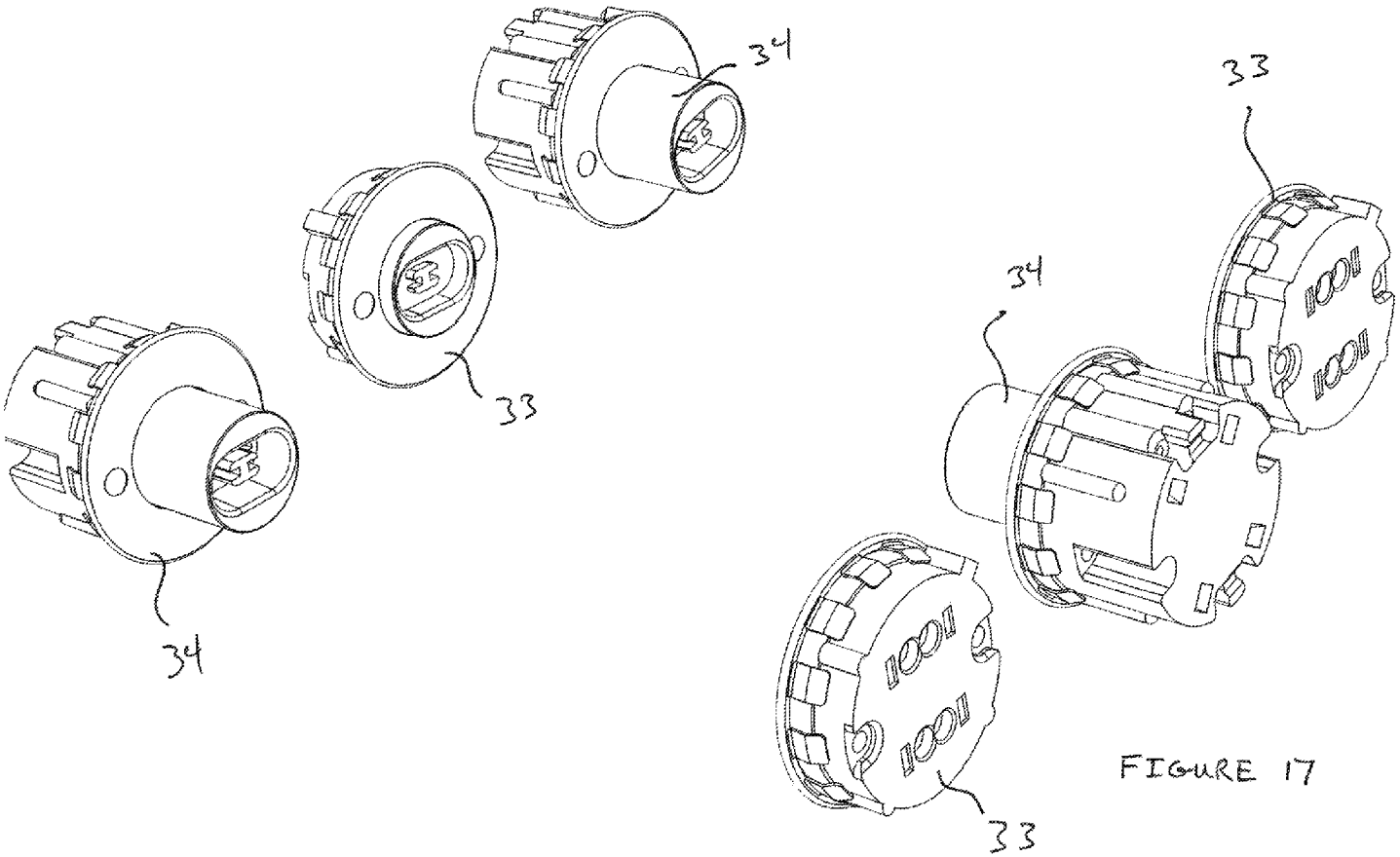
FIG. 17 is a perspective view of three pairs of turret-type sockets, wherein each pair comprises a female socket and a male socket.

Referring to FIG. 17, three pairs of turret-type sockets are shown. Each pair of sockets comprises a female socket 33 and a male socket 34. The male sockets 34 have receptacles that extend beyond the housing of the socket. These receptacles are spring loaded so that fluorescent lamps may be inserted into the receptacle of the male socket 34 until the male socket is compressed against the spring so that the opposite end of the fluorescent lamps can be inserted into the female socket 33. Because of the spring located inside the male sockets, the receptacles are biased to a position in which they retain fluorescent lamps between the male 34 and female 33 sockets. Illustrative turret-type sockets include those manufactured and sold by Leviton or Etlin Daniels.

Figure 18:
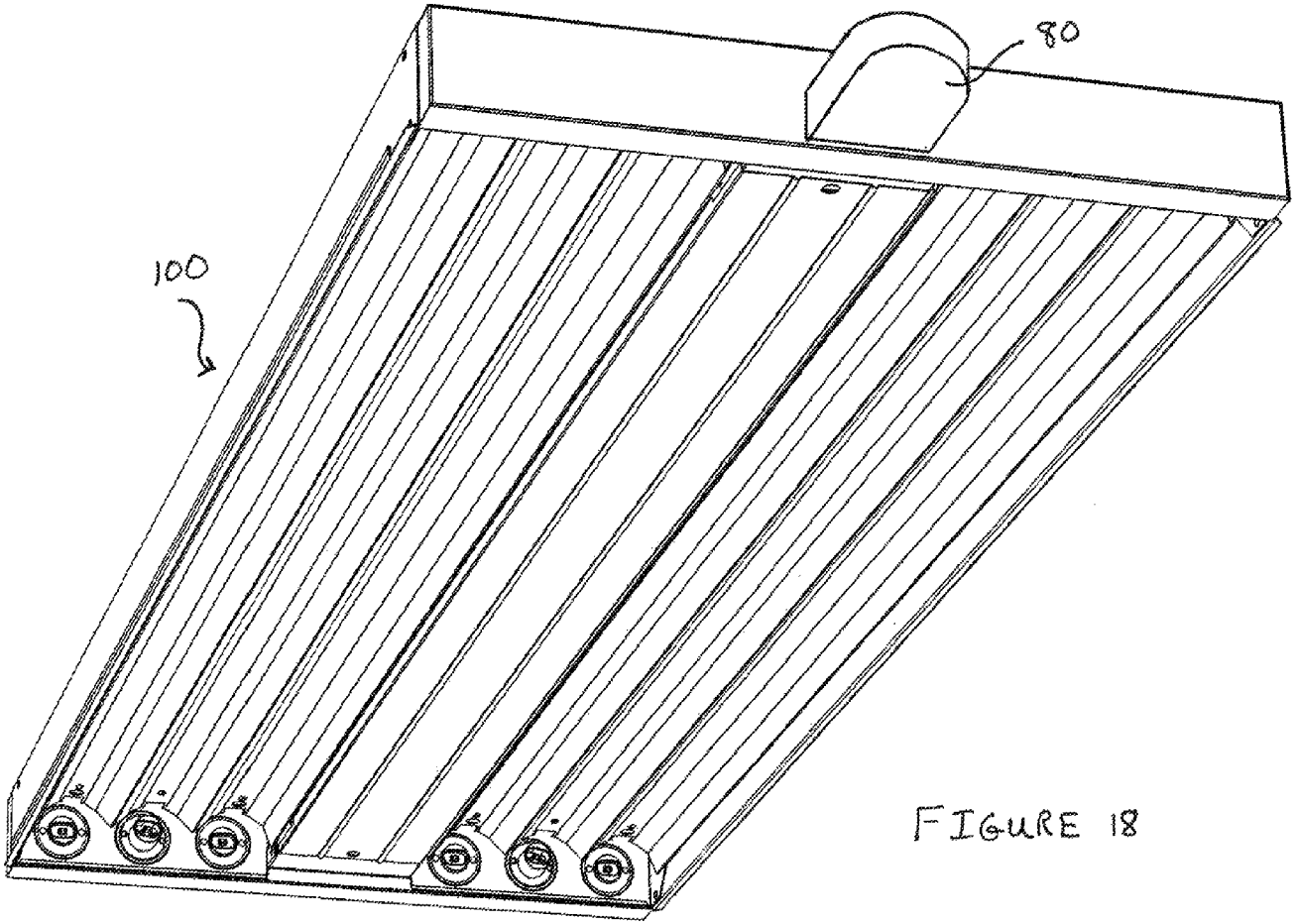
FIG. 18 is a perspective view of a fixture having a motion detector.

FIG. 18 illustrates a perspective view of a fixture 100, wherein the fixture 100 has a motion detector 80. Motion detector 80 enables the fixture to operate in an energy efficient manner such that one or more of the lamps of the fixture 100 may remain off until motion is detected proximate the fixture 100. When motion is detected, the motion detector 80 turns on the lamps of the fixture and causes the lamps to remain on for a period of time after motion is no longer detected. Motion detectors may be particularly useful in high bay applications where the fixture is being used as a "point source" for light. Where an array of fixtures 100 with motion detectors 80 are implemented in a high bay application, only the fixtures 100 detecting motion may be illuminated. In an alternative exemplary embodiment, when motion is detected by a motion detector 80 at one of the fixtures 100, that fixture 100 as well as adjacent fixtures 100 may be illuminated. Thus, light may be provided only to those areas where activities occur.

Figure 19:
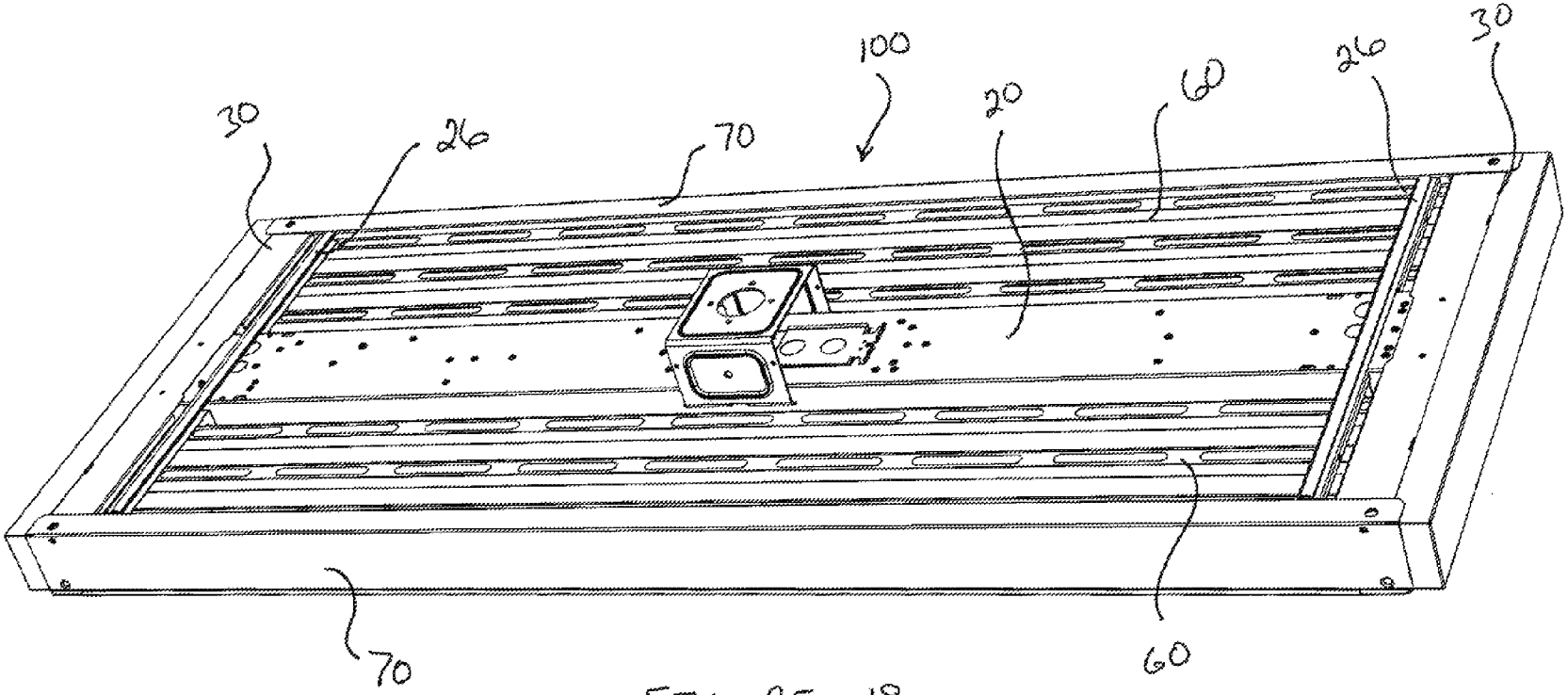
FIG. 19 is a perspective view of a fixture, wherein reflectors are supported by cross-members attached to the wire way.

FIG. 19 shows a perspective view of an alternative embodiment of the invention. In this embodiment, the reflectors 60 are not fixed to the socket housings 30, but rather they are fixed to cross-members 26. Thus, in this embodiment, the socket housings 30 do not comprise reflector mounting flanges (see FIG. 14A). The cross-members 26 are positioned to be perpendicular relative to the wire way 20. The cross-members may be fixed to the wire way 20 via metal screw-type fasteners or any other fastening means known, but one consideration is to ensure that the fastening means are U/L compliant pertaining to fasteners proximate wiring. The reflectors 60 are fixed to the cross-members 26 via metal screw-type fasteners or any other fastening means known. The reflectors may also contact portions of the socket housings 30, the wire way 20, and the side flanges 70. These points of contact may further lend support to the reflectors 60 and may further provide structural rigidity to the entire fixture 100.

Although the inventions are described with reference to preferred embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

Although the disclosed embodiments are described in detail in the present disclosure, it should be understood that various changes, substitutions and alterations can be made to the embodiments without departing from their spirit and scope.

What is claimed is:

1. A two-piece housing for turret-type fluorescent lamp sockets for high bay industrial applications, the two-piece housing comprising:

an end cap that is a first piece; and a socket track that is a second piece comprising an end wall having at least one socket hole, whereby a turret-type fluorescent lamp socket is mountable in the at least one socket hole, wherein the end cap and socket track connect with each other to form the housing.

2. A two-piece housing for turret-type fluorescent lamp sockets for high bay industrial applications, as claimed in claim 1, wherein the end cap comprises at least one tab and the socket track comprises at least one tab slot, wherein the tab is insertable into the tab slot so as to connect the end cap and the socket track.

3. A two-piece housing for turret-type fluorescent lamp sockets for high bay industrial applications, as claimed in claim 1, wherein the end cap comprises an end wall, two side walls, a back wall and a front wall configured together to form a opening, and wherein the socket track comprises at least an end wall that at least partially closes the opening in the end cap when the end cap and the socket track connect with each other to form the housing.

4. A two-piece housing for turret-type fluorescent lamp sockets for high bay industrial applications, as claimed in claim 1, further comprising at least one reflector mounting flange.

5. A two-piece housing for turret-type fluorescent lamp sockets for high bay industrial applications, as claimed in claim 1, further comprising a flange for connecting to a wire way.

6. A fluorescent luminaire fixture for high bay industrial applications, the fixture comprising:

a first industrial socket housing;

a second industrial socket housing;

a wire way comprising a first end and a second end, the first end of the wire way coupled to the first socket housing and the second end of the wire way coupled to the second socket housing;

at least one female turret-type socket mounted in the first socket housing and at least one male turret-type socket mounted in the second socket housing such that the male and female turret-type sockets are opposite each other, whereby a fluorescent lamp is receivable by the male and female turret-type sockets; and at least one reflector positioned relative to the male and female turret-type sockets, whereby light from a fluorescent lamp received by the male and female turret-type sockets is reflectable by the at least one reflector for a high bay application.

7. A fluorescent luminaire fixture for high bay industrial applications, as claimed in claim 6, wherein each of the first and second industrial socket housings comprises a two-piece housing comprising:

an end cap that is a first piece; and a socket track that is a second piece comprising an end wall having at least one socket hole, whereby a turret-type fluorescent lamp socket is mountable in the at least one socket hole, wherein the end cap and socket track connect with each other to form the housing.

8. A fluorescent luminaire fixture for high bay industrial applications, as claimed in claim 6, wherein the wire way comprises a channel that extends between the first and second industrial socket housings, and a channel cover positioned relative to the channel for form an enclosure.

9. A fluorescent luminaire fixture for high bay industrial applications, as claimed in claim 6, wherein the at least one reflector is connected directly to the first and second industrial socket housings.

10. A fluorescent luminaire fixture for high bay industrial applications, as claimed in claim 6, further comprising at least one cross-member fixed to the wire way and wherein the at least one reflector is connected to the at least one cross-member.

11. A fluorescent luminaire fixture for high bay industrial applications, as claimed in claim 6, further comprising:

a first side flange having a first end and an opposing second end, the first end coupled to the first industrial socket housing and the second end coupled to the second industrial socket housing along corresponding first sides of the first and second industrial socket housings; and a second side flange having a first end and an opposing second end, the first end coupled to the first industrial socket housing and the second end coupled to the second industrial socket housing along corresponding second sides of the first and second industrial socket housings, the corresponding second sides being opposite the corresponding first sides.

12. A fluorescent luminaire fixture for high bay industrial applications, the fixture comprising:

first and second industrial socket housing, wherein each of the first and second industrial socket housings comprises:

a first piece, and a second piece comprising at least one socket hole, whereby a turret-type fluorescent lamp socket is mountable in the at least one socket hole, and wherein the first and second pieces connect with each other to form an industrial socket housing;

a wire way comprising a first end and a second end, the first end of the wire way coupled to the first industrial socket housing and the second end of the wire way coupled to the second industrial socket housing;

at least one female turret-type socket mounted in the first industrial socket housing and at least one male turret-type socket mounted in the second industrial socket housing such that the male and female turret-type sockets are opposite each other, whereby a fluorescent lamp is receivable by the male and female turret-type sockets; and at least one reflector connected directly to the first and second industrial socket housings and positioned relative to the male and female turret-type sockets, whereby light from a fluorescent lamp received by the male and female turret-type sockets is reflectable by the at least one reflector for a high bay application.

13. A fluorescent luminaire fixture for high bay industrial applications, as claimed in claim 12, further comprising:

the first piece is an end cap; and the second piece is a socket track, wherein the end cap and socket track connect with each other to form the housing.

14. A fluorescent luminaire fixture for high bay industrial applications, as claimed in claim 12, wherein the end cap comprises at least one tab and the socket track comprises at least one tab slot, wherein the tab is insertable into the tab slot so as to connect the end cap and the socket track.

15. A fluorescent luminaire fixture for high bay industrial applications, as claimed in claim 12, wherein the end cap comprises an end wall, two side walls, a back wall and a front wall configured together to form a opening, and wherein the socket track comprises at least an end wall that at least partially closes the opening in the end cap when the end cap and the socket track connect with each other to form the housing.

16. A fluorescent luminaire fixture for high bay industrial applications, as claimed in claim 12, wherein the first and second industrial socket housings each further comprise at least one reflector mounting flange.

17. A fluorescent luminaire fixture for high bay industrial applications, as claimed in claim 12, further comprising at least one cross-member fixed to the wire way and wherein the at least one reflector is connected to the at least one cross-member.

18. A fluorescent luminaire fixture for high bay industrial applications, as claimed in claim 12, wherein the first and second industrial socket housings each further comprise a flange for connecting to a wire way.

19. A fluorescent luminaire fixture for high bay industrial applications, as claimed in claim 12, wherein the wire way comprises a channel that extends between the first and second industrial socket housings, and a channel cover positioned relative to the channel for form an enclosure.

20. A fluorescent luminaire fixture for high bay industrial applications, as claimed in claim 12, wherein the at least one reflector is connected directly to the first and second industrial socket housings.

21. A fluorescent luminaire fixture for high bay industrial applications, as claimed in claim 12, further comprising:

a first side flange having a first end and an opposing second end, the first end coupled to the first industrial socket housing and the second end coupled to the second industrial socket housing along corresponding first sides of the first and second industrial socket housings; and a second side flange having a first end and an opposing second end, the first end coupled to the first industrial socket housing and the second end coupled to the second industrial socket housing along corresponding second sides of the first and second industrial socket housings, the corresponding second sides being opposite the corresponding first sides.

22. A fluorescent luminaire fixture for high bay industrial applications, as claimed in claim 12, further comprising a motion detector.

* * * * *